US007006120B2

(12) United States Patent
Sakai et al.

(10) Patent No.: US 7,006,120 B2
(45) Date of Patent: Feb. 28, 2006

(54) MULTI-BEAM OPTICAL SCANNING APPARATUS AND IMAGE FORMING APPARATUS

(75) Inventors: Kohji Sakai, Tokyo (JP); Magane Aoki, Yokosuka (JP); Yoshinori Hayashi, Kawasaki (JP); Seizo Suzuki, Yokohama (JP); Hiromichi Atsuumi, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 190 days.

(21) Appl. No.: 10/635,520

(22) Filed: Aug. 7, 2003

(65) Prior Publication Data

US 2004/0090520 A1 May 13, 2004

(30) Foreign Application Priority Data

Aug. 7, 2002 (JP) ..... 2002-230669

(51) Int. Cl.
*B41J 27/00* (2006.01)

(52) U.S. Cl. ..... 347/243; 347/259

(58) Field of Classification Search ..... 347/240–244, 347/256–261; 359/205, 215–221, 212
See application file for complete search history.

(56) References Cited

U.S. PATENT DOCUMENTS

| | | | | |
|---|---|---|---|---|
| 4,393,387 | A * | 7/1983 | Kitamura | 347/240 |
| 5,870,132 | A * | 2/1999 | Inoue et al. | 347/243 |
| 6,535,317 | B1 * | 3/2003 | Ishibe | 359/205 |
| 6,573,921 | B1 | 6/2003 | Hayashi | 347/131 |
| 2004/0090520 | A1 | 5/2004 | Sakai et al. | |

FOREIGN PATENT DOCUMENTS

| | | |
|---|---|---|
| JP | 05-199372 | 8/1993 |
| JP | 06-273688 | 9/1994 |
| JP | 2508871 | 6/1996 |
| JP | 2001-311895 | 11/2001 |

OTHER PUBLICATIONS

U.S. Appl. No. 10/028,698, filed Dec. 28, 2001, Hayashi.
U.S. Appl. No. 10/047,698, filed Jan. 18, 2002, Suzuki.
U.S. Appl. No. 10/059,371, filed Jan. 31, 2002, Ono.
U.S. Appl. No. 10/047,092, filed Jan. 17, 2002, Atsuumi.
U.S. Appl. No. 10/161,659, Jun. 5, 2002, Suzuki et al.
U.S. Appl. No. 10/161,756, Jun. 5, 2002, Atsuumi et al.
U.S. Appl. No. 10/207,241, filed Jul. 30, 2002, Suzuki et al.

(Continued)

*Primary Examiner*—Hai Pham
(74) *Attorney, Agent, or Firm*—Oblon, Spivak, McClelland, Maier & Neustadt, P.C.

(57) ABSTRACT

A multi-beam optical scanning apparatus includes a semiconductor laser array slanted relative to a sub-scanning direction and emitting a plurality of optical beams; a coupling lens converting a shape of each optical beam emitted from the semiconductor laser array; and an aperture with an opening having a size of $A_m \times A_s$, arranged after the coupling lens in a direction in which the optical beam progresses, where $A_m$ is a dimension of the opening in a main scanning direction and $A_s$ is a dimension of the opening in the sub-scanning direction. When a length in the main scanning direction of a contour line defined by $1/e^2$ strength of a maximum strength of an optical beam at the position of the aperture is $L_m$, and a length in the sub-scanning direction of the contour line defined by $1/e^2$ strength of the maximum strength of the optical beam at the position of the aperture is $L_s$, the following conditional expressions are satisfied:

$$A_m < L_m, \text{ and} \quad (1)$$

$$L_s/L_m \times 0.3 < A_s/A_m < L_s/L_m \times 1.7. \quad (2)$$

33 Claims, 20 Drawing Sheets

OTHER PUBLICATIONS

U.S. Appl. No. 10/210,056, filed Aug. 2, 2002, Atsuumi et al.
U.S. Appl. No. 10/223,294, filed Aug. 20, 2002, Satoh et al.
U.S. Appl. No. 10/242,710, filed Sep. 13, 2002, Hayashi et al.
U.S. Appl. No. 10/247,702, filed Sep. 20, 2002, Hayashi et al.
U.S. Appl. No. 10/259,769, filed Sep. 30, 2002, Omori et al.
U.S. Appl. No. 10/278,916, filed Oct. 24, 2002, Suzuki et al.
U.S. Appl. No. 10/278,878, filed Oct. 24, 2002, Suzuki et al.
U.S. Appl. No. 10/319,624, filed Dec. 16, 2002, Ono et al.
U.S. Appl. No. 10/323,837, filed Dec. 20, 2002, Suzuki et al.
U.S. Appl. No. 10/345,365, filed Jan. 16, 2003, Kawamura et al.
U.S. Appl. No. 10/347,746, filed Jan. 22, 2003, Suzuki et al.
U.S. Appl. No. 10/375,036, filed Feb. 28, 2003, Suzuki et al.
U.S. Appl. No. 10/382,530, filed Mar. 7, 2003, Hayashi et al.
U.S. Appl. No. 10/382,489, filed Mar. 7, 2003, Takanashi et al.
U.S. Appl. No. 10/386,654, filed Mar. 13, 2003, Amada et al.
U.S. Appl. No. 10/391,580, filed Mar. 20, 2003, Sakai.
U.S. Appl. No. 10/395,128, filed Mar. 25, 2003, Hayashi et al.
U.S. Appl. No. 10/421,786, filed Apr. 24, 2003, Atsuumi et al.
U.S. Appl. No. 10/635,520, filed Aug. 7, 2003, Sakai et al.
U.S. Appl. No. 10/981,677, filed Nov. 5, 2005, Miyatake, et al.
U.S. Appl. No. 10/927,226, filed Aug. 27, 2004, Izumi et al.
U.S. Appl. No. 10/942,825, filed Sep. 17, 2004, Hayashi.
U.S. Appl. No. 10/942,907, filed Sep. 17, 2004, Miyatake et al.
U.S. Appl. No. 10/892,191, filed Jul. 16, 2004, Suzuki et al.
U.S. Appl. No. 10/866,043, filed Jun. 14, 2004, Hayashi et al.
U.S. Appl. No. 10/840,369, filed May 7, 2004, Itabashi et al.

* cited by examiner

MULTI-BEAM OPTICAL SCANNING APPARATUS AND IMAGE FORMING APPARATUS

The present application claims priority and contains subject matter related to Japanese Patent Application No. 2002-230669 filed in the Japanese Patent Office on Aug. 7, 2002, and the entire contents of which are hereby incorporated by reference.

BACKGROUND OF THE INVENTION

1. Field of the Invention

The present invention relates to an optical scanning apparatus for use in image forming apparatuses such as digital copiers and laser printers, and in more particular relates to a multi-beam optical scanning apparatus simultaneously scanning a plurality of scanning lines, and using a semiconductor laser array as a light source in which light emitting sources are arranged in a row, and an image forming apparatus using the multi-beam optical scanning apparatus.

2. Discussion of the Background

Optical scanning apparatuses are used in image forming apparatuses such as digital copiers and laser printers and are widely known. Recently, in these optical scanning apparatuses, optical scanning at a higher writing resolution, e.g., 1200 dpi (dot per inch) or 2400 dpi, is demanded.

Also, as a method of increasing the speed of optical scanning, multi-beam methods where a plurality scanning lines on a scanning surface are simultaneously scanned are gaining attention. For example, a multi-beam optical scanning apparatus using a monolithic laser diode (LD) array or a semiconductor laser array in which light emitting sources are arranged in a row as a light source is now being realized. When such a monolithic LD array is used as a light source, an optical system on a light path from the light source to a scanning surface can be commonly used by a plurality of beams, as in a single-beam optical scanning apparatus using a light source having a single light emitting source. Accordingly, it is possible to realize a multi-beam optical scanning apparatus that is relatively stable against mechanical movements, using such a semiconductor laser array for the light source.

To accomplish optical scanning at a high resolution such as 1200 dpi or 2400 dpi by a multi-beam optical scanning apparatus using a semiconductor laser array, the interval between the light emitting sources of the semiconductor laser array needs to be sufficiently small. For example, when the pitch of a plurality of scanning lines simultaneously scanned by a plurality of beams is a distance corresponding to one scanning line (i.e., as in a so-called adjacent line scanning method), to achieve the writing resolution of 2400 dpi, generally, the interval between light emitting sources of a light source needs to be smaller than 10 $\mu$m.

When a monolithic semiconductor laser array is used for a light source, if the interval between the light emitting sources of the semiconductor laser array is smaller than 10 $\mu$m, turning on and off of one light emitting source affects turning on and off of an adjacent light emitting source thermally and electrically, so that it is difficult to independently control modulation of each light emitting source. A method for increasing the interval between the light emitting sources of a semiconductor laser array to a certain extent while realizing multi-beam scanning at a relatively high resolution is described for example in Japanese Patent publication No. 2508871.

In this method, the pitch of a plurality of scanning lines simultaneously scanned by a plurality beams is a distance corresponding to more than one scanning lines, i.e., adjacent beams scan a plurality of scanning lines on a scanning surface with a pitch equal to or larger than a distance corresponding to more than one scanning lines. In this case, however, positions where respective beams pass in a scanning optical system are largely separated from each other with respect to the sub-scanning direction. This means that an optical function of the optical scanning system differs for each beam. In particular, a magnification ratio with respect to the sub-scanning direction changes according to an image height of an optical spot, so that a scanning line pitch greatly changes according to the image height. When optical scanning is performed at a relatively high resolution, such a change in a scanning line pitch is relatively large and causes deterioration in the resulting image quality.

As another method of increasing the interval between the light emitting sources of a semiconductor laser array to a certain extent while realizing multi-beam scanning at a relative high resolution, it is proposed to slant the semiconductor laser array to decrease the apparent interval between the light emitting sources of the semiconductor laser array and to simultaneously scan adjacent scanning lines on a scanning surface.

When a semiconductor laser array or an LD array that is slanted as described above is used for a light source of a multi-beam optical scanning apparatus, optical spot diameters are largely influenced by variation in diverging angles of the semiconductor laser array, and the optical spot diameters may be caused to be out of a range of predetermined values for example by environmental changes. When using a semiconductor laser array for a light source in a slanted condition, light quantity on a scanning surface needs to be considered. Further, accuracy in attaching the semiconductor laser array to an optical scanning apparatus greatly influences changes in a scanning line pitch on the scanning surface. Therefore, the accuracy in attaching the semiconductor laser array to the optical scanning apparatus needs to be considered.

SUMMARY OF THE INVENTION

The present invention has been made in view of the above-discussed and other problems and addresses the above-discussed and other problems.

Preferred embodiments of the present invention provide a novel multi-beam optical scanning apparatus using a semiconductor laser array, that performs multi-beam optical scanning at a relatively high resolution, and an image forming apparatus using the optical scanning apparatus.

According to a preferred embodiment of the present invention, a multi-beam optical scanning apparatus includes a semiconductor laser array slanted relative to a sub-scanning direction and emitting a plurality of optical beams; a coupling lens converting a shape of each optical beam emitted from the semiconductor laser array; and an aperture with an opening having a size of $A_m \times A_s$, arranged after the coupling lens in a direction in which the optical beam progresses.

Further, $A_m$ is a dimension of the opening in a main scanning direction and $A_s$ is a dimension of the opening in the sub-scanning direction. When a length in the main scanning direction of a contour line defined by $1/e^2$ strength of a maximum strength of an optical beam at the position of the aperture is $L_m$, and a length in the sub-scanning direction of the contour line defined by $1/e^2$ strength of the maximum strength of the optical beam at the position of the aperture is $L_s$, the following conditional expressions are satisfied:

$$A_m<L_m \quad (1), \text{ and}$$

$$L_s/L_m\times0.3<A_s/A_m<L_s/L_m\times1.7 \quad (2).$$

By adopting the above-described configuration, the multi-beam optical scanning apparatus of the present invention can perform optical scanning at a relatively high resolution and in particular can secure satisfactory light quantity on a scanning surface.

According to another preferred embodiment of the present invention, a multi-beam optical scanning apparatus includes a semiconductor laser array slanted relative to a sub-scanning direction and emitting a plurality of optical beams; a coupling lens converting a shape of each optical beam emitted from the semiconductor laser array; an optical deflector deflecting the optical beam in a main scanning direction; and an image forming optical system arranged after the optical deflector in a direction in which the optical beam progresses and condensing the optical beam to obtain an optical spot having a size of $\omega_m\times\omega_s$ on a scanning surface.

Further, $\omega_m$ is a dimension of the optical spot in the main scanning direction and $\omega_s$ is a dimension of the optical spot in the sub-scanning direction. When an image forming lateral magnification of the image forming optical system in the sub-scanning direction is $\beta$; an interval between light emitting points of the semiconductor laser array is $P_{LD}$; a rotation angle of the semiconductor laser array is $\gamma$; the number of the light emitting points of the semiconductor laser array is $\gamma$; a distance from the coupling lens to the optical deflector is d; and a focal length of the coupling lens is $f_{COL}$, the following conditional expression is satisfied:

$$0<\{\beta\times P_{LD}\times\sin\gamma\times(n-1)\times(d-f_{COL})/f_{COL}\}/\omega_s<100 \quad (3).$$

By adopting the above-described configuration, the multi-beam optical scanning apparatus of the present invention can effectively decrease variation in optical spot diameters.

In the above-described multi-beam optical scanning apparatuses, when a size of an effective area of a surface of an optical deflector is $D_m\times D_s$, $D_m$ being a dimension of the effective area in the main scanning direction and $D_s$ being a dimension of the effective area in the sub-scanning direction, a distance in the main scanning direction between optical beams of the plurality of optical beams reaching the optical deflector, that are separated at most in the main scanning direction, is $\delta$, and an effective writing width on a scanning surface is W, the following conditional expression may be satisfied:

$$(D_m\times\omega_m)/(\delta\times W)>5\times10^{-4} \quad (4).$$

By adopting the above-described configuration, the multi-beam optical scanning apparatuses of the present invention can secure an effective writing width on the scanning surface.

Further, in the above-described multi-beam optical scanning apparatuses, when an image forming lateral magnification of an entire system of each optical scanning apparatus in the sub-scanning direction is $\alpha$, the following conditional expression may be satisfied:

$$P_{LD}\times(n-1)\times\alpha\times(\cos(\gamma-1)-\cos\gamma)\times dpi/25.4<0.5 \quad (5).$$

By adopting the above-described configuration, the multi-beam optical scanning apparatuses of the present invention can effectively decrease variation in a scanning line pitch.

Furthermore, the above-described multi-beam optical scanning apparatuses may include a synchronization detect device arranged at a position equivalent to the scanning surface and configured to obtain a synchronization signal based upon one of the plurality of optical beams. In this case, when a distance between adjacent optical beams on the scanning surface is $\Delta$, and an angle relative to the main scanning direction of the adjacent optical beams on the scanning surface is $\theta$, the following conditional expression is satisfied:

$$\Delta\times(\cos(\theta-1)-\cos\theta)\times dpi/25.4<1/8 \quad (6).$$

By adopting the above-described configuration, the multi-beam optical scanning apparatuses of the present invention can easily and appropriately obtain a synchronization signal.

Further, the synchronization detect device may be arranged at the side of a scanning starting position. In this case, the synchronization signal is obtained based upon an optical beam of the plurality of optical beams, that is incident onto the synchronization detect device last among the plurality of optical beams. With this configuration, freedom in arranging the synchronization detect device in the multi-beam scanning apparatuses is increased.

Still further, the above-described multi-beam optical scanning apparatuses may include a synchronization detect device arranged at a position equivalent to the scanning surface and configured to obtain a synchronization signal for each of the plurality of optical beams. In this case, the following conditional expression is satisfied:

$$\Delta\times\cos\theta>3\times\omega_m \quad (7).$$

By adopting this configuration, the multi-beam optical scanning apparatuses of the present invention can obtain synchronization signals of respective beams, individually.

Still further, in the above-described multi-beam optical scanning apparatuses, $\beta$ may satisfy the following conditional expression:

$$0.5<\beta<1.5 \quad (8).$$

With this configuration, a variation in beam waist positions in the sub-scanning direction on the scanning surface can be decreased even when optical sag exists.

Further, in the above-described multi-beam optical scanning apparatuses, $P_{LD}$ may be equal to or smaller than 100 $\mu$m. Thereby, accuracy required in attaching the semiconductor laser array to each optical scanning apparatus is moderated.

Further, in the above-described multi-beam optical scanning apparatuses, the opening of the aperture may be in an ellipse shape. Thereby, a variation in optical spot diameters caused by variation in diverging angles of the semiconductor laser array is effectively suppressed, so that stable beam spots can be obtained.

According to another preferred embodiment of the present invention, an image forming apparatus is provided. The image forming apparatus includes a photoconductive image bearing member, an optical scanning device configured to scan a scanning surface of the photoconductive image bearing member with a plurality of optical beams to form an electrostatic latent image thereupon, and a development device configured to visualize the electrostatic latent image. The image forming apparatus uses any of the above-described multi-beam optical scanning apparatuses for the optical scanning device, so that images can be formed at a relatively high resolution.

BRIEF DESCRIPTION OF THE DRAWINGS

A more complete appreciation of the present invention and many of attendant advantages thereof will be readily obtained as the same becomes better understood by reference to the following detailed description when considered in conjunction with accompanying drawings, wherein.

DETAILED DESCRIPTION OF THE PREFERRED EMBODIMENTS

Figure 1:
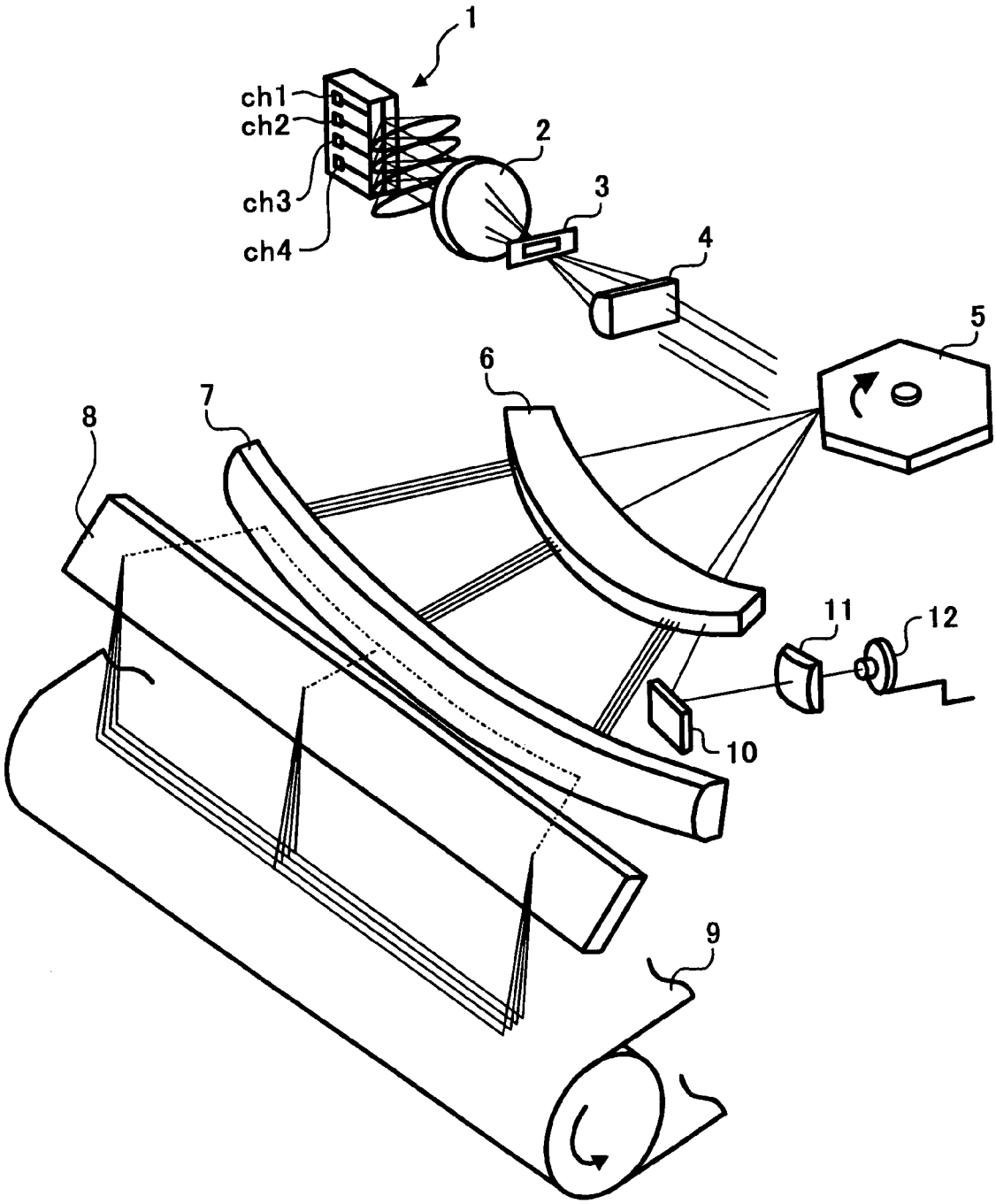
FIG. 1 is a diagram schematically illustrating an exemplary construction of a multi-beam optical scanning apparatus according to a preferred embodiment of the present invention.

Referring now to the drawings, wherein like reference numerals designate identical or corresponding parts throughout the several views, preferred embodiments of the present invention are described.

FIG. 1 schematically illustrates an exemplary construction of a multi-beam optical scanning apparatus according to a preferred embodiment of the present invention. The multi-beam optical scanning apparatus includes a semiconductor laser array (laser diode array) 1, a coupling lens 2, an aperture (diaphragm) 3, a cylindrical lens 4, a rotating multi-faced mirror (polygon mirror) 5, a first image forming lens 6, a second image forming lens 7, a folding mirror 8, a photoconductor 9, a branching mirror 10, a condensing lens 11, and a light receiving element 12.

The semiconductor laser array 1 includes a plurality of light emitting sources, e.g., four light emitting sources: a first light emitting source ch1, a second light emitting source ch2, a third light emitting source ch3, and a fourth light emitting source ch4. Optical beams from the plurality of light emitting sources ch1, ch2, ch3, ch4 of the semiconductor laser array 1 are coupled with a subsequent optical system in common by the coupling lens 2. The coupled optical beams may be formed in weak divergent or condensing fluxes or parallel fluxes, according to the optical characteristic of the subsequent optical system. When each flux transmitted through the coupling lens 2 passes an opening of the aperture 3, the peripheral part thereof is blocked by the aperture 3 to be removed, and the flux then launches onto the cylindrical lens 4 serving as a line image forming optical system.

The cylindrical lens 4 has no refracting power in the direction corresponding to the main scanning direction and has a positive refracting power in the direction corresponding to the sub-scanning direction. The cylindrical lens 4 converges each incident beam in the sub-scanning direction and condenses the beam in the vicinity of a reflective deflecting surface of the rotating multi-faced mirror (polygon mirror) 5 serving as an optical deflector, which is driven to rotate at a constant velocity.

The beams reflected by the reflective deflecting surface of the rotating multi-faced mirror 5 transmit through the first and second image forming lenses 6 and 7 serving as an image forming optical system while the beams are deflected at equiangular velocity as the multi-faced mirror 5 rotates. The beams are then deflected by the folding mirror 8 folding the light path to be condensed as a plurality of optical spots separated from each other in the sub-scanning direction on the photoconductor 9. The photoconductor 9 serves as the substance of a scanning surface. A plurality of scanning lines on the scanning surface are simultaneously scanned by the plurality of optical spots.

The beams launch onto the branching mirror 10 to be extracted, respectively, prior to scanning respective scanning lines on the scanning surface. The extracted beams are condensed by the condensing lens 11, and launch onto the light receiving element 12, respectively. The start times for optical writing with optical scanning are set to be synchronized with the optical scanning based upon outputs of the light receiving element 12.

Figure 2:
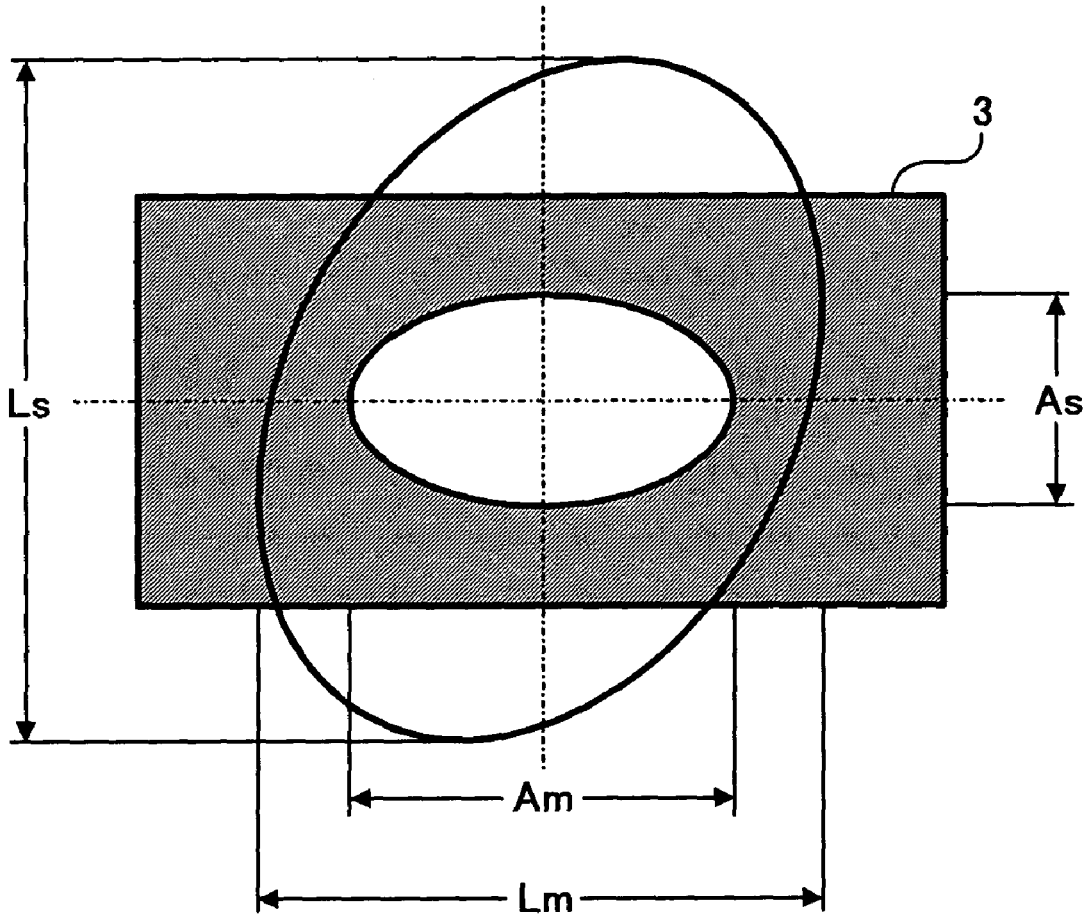
FIG. 2 is diagram schematically illustrating a contour line defined by $1/e^2$ strength of a maximum strength of an optical beam at the position of an aperture of the multi-beam optical scanning apparatus.

Turning now to FIG. 2, which illustrates a contour line defined by $1/e^2$ strength of a maximum strength of an optical beam emitted from the semiconductor laser array 1 at the position of the aperture 3 after passing the coupling lens 2. The aperture 3 of FIG. 2 is configured to have an elliptic opening of $A_m \times A_s$. However, the shape of the opening of the aperture 3 is not limited to such an elliptic shape and may be a rectangle or an oval which is close to an ellipse. When the shape of the opening of the aperture 3 is a rectangle, the optical strength of a flux passing the opening of the aperture 3 is relatively weak at parts of the flux passing four corners of the opening. When the shape of the opening of the aperture 3 is an ellipse or oval, such parts of a flux where optical strength is relatively weak when the shape of the opening is a rectangle can be removed.

Accordingly, by forming the opening of the aperture 3 in an ellipse or an oval that is close to an ellipse, it is possible to effectively suppress changes in optical spot diameters, which may be caused by a variation in diverging angles of the semiconductor laser array 1. Suffixes "m" and "s" in $A_m$, $A_s$, etc. represent the main scanning direction and the sub-scanning direction, respectively. These suffixes are used in a similar manner for other symbols as necessary.

According to the first aspect of the present invention, the above-described multi-beam optical scanning apparatus of the present invention includes the semiconductor laser array 1 slanted relative to the sub-scanning direction and emitting a plurality of optical beams, the coupling lens 2 converting a shape of each optical beam emitted from the semiconductor laser array 1, and the aperture 3 with an opening having a size of $A_m \times A_s$, arranged after the coupling lens 2 in a direction in which the optical beam progresses. Further, $A_m$ is a dimension of the opening in the main scanning direction and $A_s$ is a dimension of the opening in the sub-scanning direction. When a length in the main scanning direction of a contour line defined by $1/e^2$ strength of a maximum strength of an optical beam at the position of the aperture 3 is $L_m$, and a length in the sub-scanning direction of the contour line defined by $1/e^2$ strength of the maximum strength of the optical beam at the position of the aperture 3 is $L_s$, the following conditional expressions are satisfied:

$$A_m < L_m \quad (1), \text{ and}$$

$$L_s/L_m \times 0.3 < A_s/A_m < L_s/L_m \times 1.7 \quad (2).$$

In the first aspect of the present invention, the above-described two conditional expressions are given for securing a sufficient light quantity on the scanning surface. The light quantity on the scanning surface is maximized when a value of $A_s/A_m$ agrees with that of $L_s/L_m$. However, the size of an opening of the aperture 3 is determined based upon the size of an optical spot on the scanning surface and an optical system arranged between the semiconductor laser array 1 as a light source and the scanning surface. Therefore, the size of the opening of the aperture 3 cannot be arbitrarily determined such that the light quantity on the scanning surface is maximized. Accordingly, to obtain a satisfactory optical spot on the scanning surface while securing sufficient light quantity on the scanning surface, it is preferable that the value of $A_s/A_m$ is suppressed to be equal to or within ±70% of that of $L_s/L_m$.

When the semiconductor laser array 1 is slanted, the width in the main scanning direction of an optical spot at the position of the aperture 3 decreases, so that a variation in optical spot diameters due to a variation in diverging angles of the semiconductor laser array 1 increases. To effectively suppress such a variation in optical spot diameters, the conditional expression (1) must be satisfied.

As described above, according to the first aspect of the present invention, in the above-described multi-beam optical scanning apparatus of the present invention, the conditional expressions (1) and (2) are satisfied, so that a satisfactory light quantity is secured on the scanning surface.

According to the second aspect of the present invention, the above-described multi-beam optical scanning apparatus of the present invention includes the semiconductor laser array 1 slanted relative to the sub-scanning direction and emitting a plurality of optical beams, the coupling lens 2 converting a shape of each optical beam emitted from the semiconductor laser array 1, the rotating multi-faced mirror 5 serving as an optical deflector deflecting the optical beam in the main scanning direction, and the first and second image forming lenses 6 and 7 serving as an image forming optical system arranged after the multi-faced mirror (optical deflector) 5 in a direction in which the optical beam progresses and condensing the optical beam to obtain an optical spot having a size of $\omega_m \times \omega_s$ on the scanning surface.

Here, $\omega_m$ is a dimension of the optical spot in the main scanning direction and $\omega_s$ is a dimension of the optical spot in the sub-scanning direction. When an image forming lateral magnification in the sub-scanning direction of the image forming optical system constituted of the first and second image forming lenses 6 and 7 is β, an interval between light emitting points of the semiconductor laser array 1 is $P_{LD}$, a rotation angle of the semiconductor laser array 1 is γ, the number of the light emitting points of the semiconductor laser array 1 is n, a distance from the coupling lens 2 to the multi-faced mirror (optical deflector) 5 is d, and a focal length of the coupling lens 2 is $f_{COL}$, the following conditional expression is satisfied:

$$0 < \{\beta \times P_{LD} \times \sin\gamma \times (n-1) \times (d - f_{COL})/f_{COL}\}/\omega_s < 100 \quad (3).$$

In the above-described second aspect of the present invention, the conditional expression (3) is given for securing an optical spot diameter in the sub-scanning direction, on the scanning surface. When using a semiconductor laser array in a slanted condition, optical beams are separated from each other in the main scanning direction, causing optical sag. Because of such optical sag, a variation in beam waist positions is caused among image heights in the sub-scanning direction, and as a result a problem is caused such that it is impossible to secure optical spot diameters in the sub-scanning direction over the entire portion of the effective writing width.

This problem becomes significant as the optical spot diameter is decreased. On the other hand, this problem is influenced by an image forming lateral magnification in the sub-scanning direction of an image forming optical system provided after the rotating multi-faced mirror 5 functioning as an optical deflector, so that even when such optical sag is large, if the image forming lateral magnification in the sub-scanning direction of the image forming optical system is small, a variation in the beam waist positions in the sub-scanning direction on the scanning surface may be decreased such that the above-described problem may be negligible.

According to the second aspect of the present invention, in the above-described multi-beam optical scanning apparatus of the present invention, variation in beam waist positions in the sub-scanning direction is specified by the conditional expression (3) to be relatively small.

According to the third aspect of the present invention, in the above-described multi-beam optical scanning apparatus according to the first or second aspect of the present invention, when a size of an effective area of a surface of the rotating multi-faced mirror (optical deflector) 5 is $D_m \times D_s$, $D_m$ being a dimension of the effective area in the main scanning direction and $D_s$ being a dimension of the effective area in the sub-scanning direction, a distance in the main scanning direction between optical beams of the plurality of optical beams reaching the multi-faced mirror (optical deflector) 5, that are separated at most in the main scanning direction, is δ, and an effective writing width on the scanning surface is W, the following conditional expression is satisfied:

$$(D_m \times \omega_m)/(\delta \times W) > 5 \times 10^{-4} \quad (4).$$

Figure 3A:
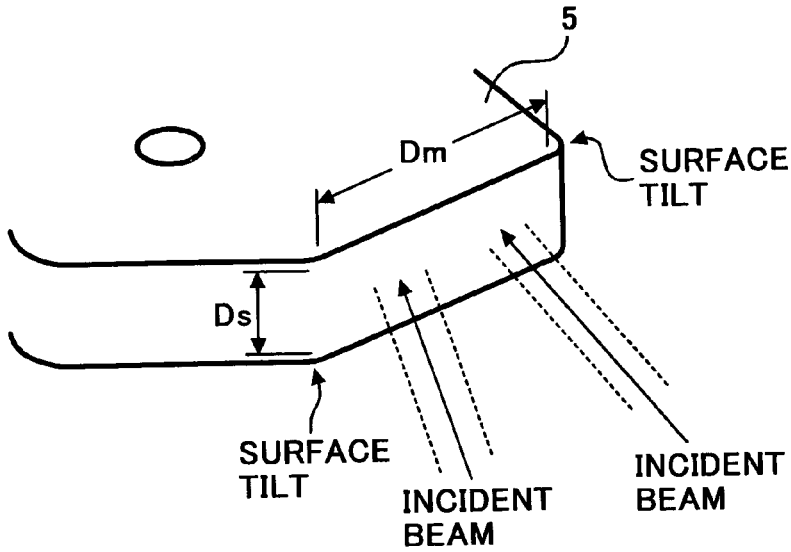
FIG. 3A is a partial oblique perspective view of a rotating multi-faced mirror of the multi-beam optical scanning apparatus, for explaining a relation between a surface of the rotating multi-faced mirror and an effective writing width.
Figure 3B:
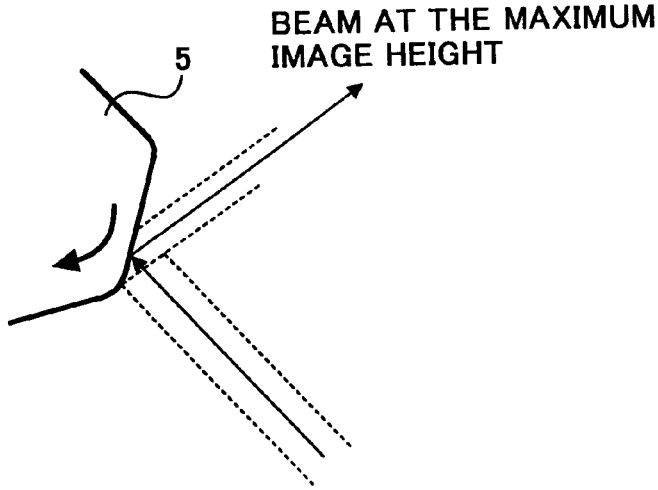
FIG. 3B is a partial plane view of the rotating multi-faced mirror for explaining an optical beam at the maximum image height.
Figure 3C:
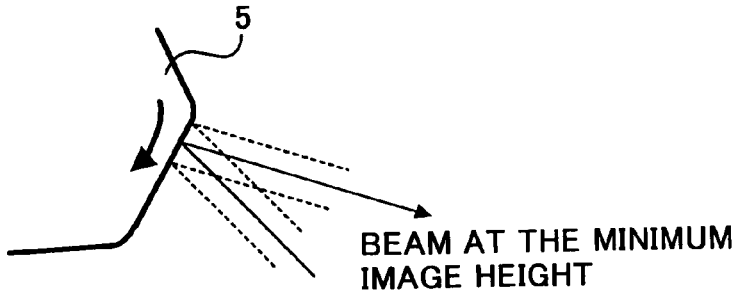
FIG. 3C is another partial plane view of the rotating multi-faced mirror for explaining an optical beam at the minimum image height.

In the third aspect of the present invention, the conditional expression (4) is given for securing an effective writing width on the scanning surface. An effective writing width on the scanning surface is determined by the size of an effective area of a reflecting deflecting surface of the rotating multi-faced mirror 5 functioning as an optical deflector. FIG. 3A is a partial oblique perspective view of the rotating multi-faced mirror 5 for explaining an effective area of a surface of the rotating multi-faced mirror 5, FIG. 3B is a plane view of the multi-faced mirror (optical deflector) 5 for explaining an optical beam at the maximum image height, and FIG. 3C is a plane view of the multi-faced mirror (optical deflector) 5 for explaining an optical beam at the minimum image height. The size of a reflecting deflecting surface of the rotating multi-faced mirror 5 formed in a regular polygonal pillar-like shape is obtained by the radius of an inscribed circle of a regular polygon at a cross section and the number of angles, i.e., the number of surfaces, of the multi-faced mirror 5.

In reality, however, because a surface tilt exists in the vicinity of both end parts of each surface of a polygonal pillar, the entire part of each surface of the polygonal pillar-like shaped multi-faced mirror 5 cannot be used as an effective area for reflecting and deflecting an incident beam. Accordingly, as the diameter size of an optical beam incident on a reflecting deflecting surface of the multi-faced mirror 5 increases, it is difficult to secure an effective writing width on the scanning surface. The diameter size of an optical beam is determined by the optical spot size of $\omega_m \times \omega_s$ on the scanning surface, and as the optical spot size decreases, it is difficult to secure the effective writing width on the scanning surface. Also, as the distance in the main scanning direction between optical beams of a plurality of optical beams reaching the rotating multi-faced mirror 5, that are separated at most in the direction corresponding to the main scanning direction, increases, the effective writing width decreases. Here, the optical spot size of $\omega_m \times \omega_s$ is defined by $1/e^2$ strength of the maximum strength of an optical beam.

According to the third aspect of the present invention, in the multi-beam optical scanning apparatus of the present invention according to the first or second aspect of the present invention, the conditional expression (4) is satisfied, so that an effective writing width on the scanning surface is secured.

According to the fourth aspect of the present invention, in the multi-beam optical scanning apparatus according to the first, second or third aspect of the present invention, when an image forming lateral magnification of an entire system of the optical scanning apparatus in the sub-scanning direction is α, an interval between light emitting points of the semiconductor laser array 1 is $P_{LD}$, a rotation angle of the semiconductor laser array 1 is γ, the number of the light emitting points of the semiconductor laser array 1 is n, the following conditional expression is satisfied:

$$P_{LD} \times (n-1) \times \alpha \times (\cos(\gamma-1) - \cos\gamma) \times dpi/25.4 < 0.5 \quad (5).$$

In the fourth aspect of the present invention, the conditional expression (5) is given for securing a scanning line pitch on the scanning surface. When the semiconductor laser array 1 is used in a slanted condition in the multi-beam optical scanning apparatus, an accuracy in attaching the semiconductor laser array 1 to the optical scanning apparatus is important, because the scanning line pitch on the scanning surface changes by the accuracy in attaching the semiconductor laser array 1 to the optical scanning apparatus. Changes in the scanning line pitch cause deterioration of a resulting image.

To suppress such deterioration of a resulting image, it is preferable to make changes in the scanning line pitch to be equal to or smaller than 0.5 times of the scanning line pitch. The accuracy in attaching the semiconductor laser array 1 to the optical scanning apparatus may be such that a variation in a slanting angle of the semiconductor laser array 1 is within about 1° relative to the slanting angle of the semiconductor laser array 1. Accordingly, a change in the scanning line pitch can be expressed by $P_{LD} \times (n-1) \times \alpha \times (\cos(\gamma-1) - \cos\gamma)$. From the condition to make the value of the change in the scanning line pitch to be equal to or smaller than 0.5 times of the scanning line pitch, the above conditional expression (5) is obtained.

Thus, according to the fourth aspect of the present invention, in the multi-beam scanning apparatus according to the first, second or third aspect of the present invention, the conditional expression (5) is satisfied, so that a variation in the scanning line pitch is relatively small.

According to the fifth aspect of the present invention, in the multi-beam optical scanning apparatus according to the first, second, third or fourth aspect of the present invention, the light receiving element 12 serving as a synchronization detect device is arranged at a position equivalent to the scanning surface. The light receiving element 12 as the synchronization detect device obtains a synchronization signal based upon one of the plurality of optical beams, and when a distance between adjacent optical beams on the scanning surface is Δ, and an angle relative to the main scanning direction of the adjacent optical beams on the scanning surface is θ, the following conditional expression is satisfied:

$$\Delta \times (\cos(\theta-1) - \cos\theta) \times dpi/25.4 < 1/8 \quad (6).$$

In the fifth aspect of the present invention, the conditional expression (6) is given for obtaining a synchronization signal. In a known method of obtaining synchronization signals in an optical scanning apparatus using a semiconductor laser array in a slanted condition, a synchronization signal is obtained from one of a plurality of optical beams simultaneously scanning a scanning surface and synchronization signals for the other beams of the plurality of optical beams are obtained by performing electrical compensation using a delay circuit. In this case, the intervals of the plurality of optical beams in the main scanning direction when the beams pass a synchronization detect device must be always constant. In actuality, as indicated by the conditional expression (6), the intervals of the plurality of optical beams in the main scanning direction must be equal to or smaller than ⅛ of a required scanning line pitch when accuracy in attaching the semiconductor laser array to the optical scanning apparatus is such that variation in a slanting angle of the semiconductor laser array is about 1° relative to the slanting angle of the semiconductor laser array.

According to the fifth aspect of the present invention, in the multi-beam optical scanning apparatus according to the first, second, third or fourth aspect of the present invention, the conditional expression (6) is satisfied, so that the intervals of the plurality of optical beams are equal to or smaller than ⅛ of the scanning line pitch, and thereby a synchronization signal is easily and appropriately obtained.

Figure 4:
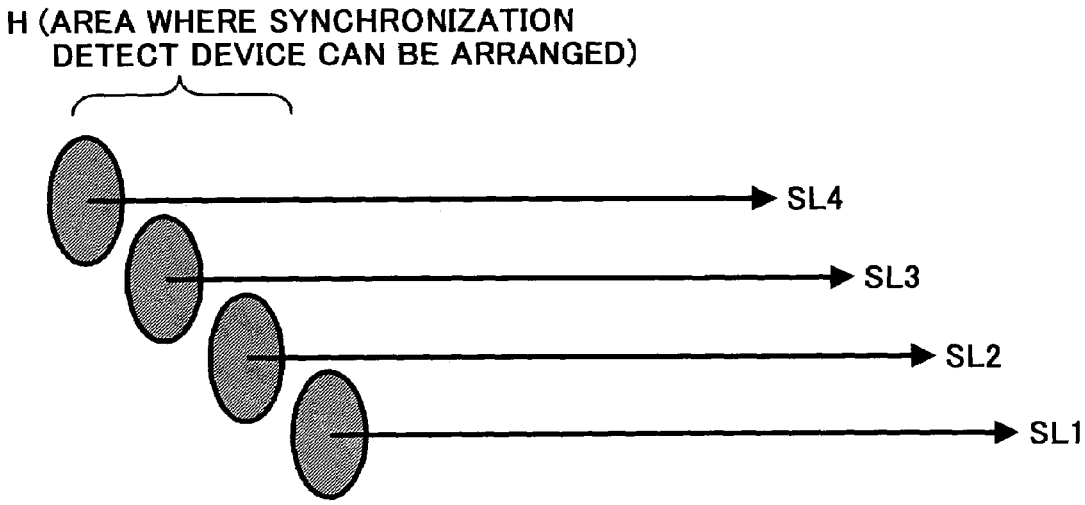
FIG. 4 is a diagram schematically illustrating beam spots by a plurality of optical beams and scanning lines scanned by the beam spots on a scanning surface of the multi-beam optical scanning apparatus.

According to the sixth aspect of the present invention, in the multi-beam optical scanning apparatus according to the fifth aspect of the present invention, the light receiving element 12 as a synchronization detect device is arranged at the side of a scanning starting position, and the synchronization signal is obtained based upon an optical beam of the plurality of optical beams, that is incident onto the light receiving element 12 as a synchronization detect device last among the plurality of optical beams. When the semiconductor laser array 1 is slanted, as illustrated in FIG. 4, scanning lines SL1, SL2, SL3, and SL4 on the scanning surface are scanned by corresponding optical beams with respective scanning starting positions shifted one by one in incremental steps.

Here, when the scanning lines SL1-SL4 are scanned by the optical beams in the directions indicated by arrows in figure, respectively, the optical beam that launches onto the light receiving element 12 last among the optical beams is the one corresponding to the scanning line SL4. When obtaining a synchronization signal with this beam corresponding to the scanning line SL4, the light receiving element 12 can be arranged anyplace in a range H illustrated in FIG. 4. Accordingly, an advantage is obtained such that a freedom with respect to the position for arranging the light receiving element 12 is greater than when obtaining a synchronization signal based upon the optical beam corresponding to the scanning line SL1.

Thus, according to the sixth aspect of the present invention, in the multi-beam optical scanning apparatus according to the fifth aspect of the present invention, a freedom in arranging a synchronization detect device is increased.

According to the seventh aspect of the present invention, the above-described multi-beam optical scanning apparatus according to the first, second, third or fourth aspect of the present invention includes the light receiving element 12 as a synchronization detect device, arranged at a position equivalent to the scanning surface and configured to obtain a synchronization signal for each of the plurality of optical beams. When a distance between adjacent optical beams on the scanning surface is Δ, and an angle relative to the main scanning direction of the adjacent optical beams on the scanning surface is θ, the following conditional expression is satisfied:

$$\Delta \times \cos\theta > 3 \times \omega_m \quad (7).$$

In the seventh aspect of the present invention, the conditional expression (7) is given for obtaining synchronization signals individually from a plurality of optical beams. For obtaining respective synchronization signals from a plurality of optical beams, the plurality of optical beams must be separated from each other in the main scanning direction at a synchronization detect device. Practically, the plurality of optical beams must be separated from each other by three times of an optical spot diameter in the main scanning direction, as indicated by the conditional expression (7). According to the seventh aspect of the present invention, in the multi-beam optical scanning apparatus according to the first, second, third or fourth aspect of the present invention, the conditional expression (7) is satisfied, so that synchronization signals of respective beams can be individually obtained. Accordingly, a method of obtaining synchronization signals individually from a plurality of optical beams can be adopted, so that the condition relative to accuracy in attaching the semiconductor laser array 1 to the multi-beam optical scanning apparatus is moderated and consequently satisfactory images can be always obtained.

According to the eighth aspect of the present invention, in the multi-beam optical scanning apparatus according to the first, second, third or fourth aspect of the present invention, β satisfies the following conditional expression:

$$0.5 < \beta < 1.5 \quad (8).$$

In the eight aspect of the present invention, the conditional expression (8) is given to define the image forming lateral magnification in the sub-scanning direction of the image forming optical system constituted of the first and second image forming lenses 6 and 7. When this conditional expression (8) is satisfied, a variation in beam waist positions in the sub-scanning direction on the scanning surface is decreased even when optical sag exists.

According to the ninth aspect of the present invention, the intervals of light emitting points of the semiconductor laser array 1 are made to be equal to or smaller than 100 μm. If the intervals of the light emitting points of the semiconductor laser array 1 are greater than 100 μm, the slanting angle γ must be set approximately at 90° to obtain a desired scanning line pitch on the scanning surface. In this case, a required accuracy in attaching the semiconductor laser array 1 to the optical scanning apparatus is significantly increased, so that a production efficiency is decreased and thereby the production cost is increased. In the ninth aspect of the present invention, by making the intervals of light emitting points of the semiconductor laser array 1 to be equal to or smaller than 100 μm, an accuracy required in attaching the semiconductor laser array 1 to the optical scanning apparatus is moderated.

According to the tenth aspect of the present invention, the opening of the aperture 3 is formed in an ellipse. By forming the opening of the aperture 3 in an ellipse, a variation in optical spot diameters caused by a variation in diverging angles of the semiconductor laser array 1 is effectively suppressed. Thereby, stable optical spots can be obtained.

Now, concrete examples of the multi-beam optical scanning apparatus of the present invention are described.

In the following description, a non-arc shape in the main scanning cross section is expressed by the following polynomial formula (9), where $R_m$ represents a paraxial radius of curvature in the main scanning cross section, Y represents a distance in the main scanning direction from an optical axis, K represents a cone constant, $A_1$, $A_2$, $A_3$, $A_4$, $A_5$, $A_6$, . . . represent coefficients of high degree, and X represents a depth in the optical axis direction:

$$X=\{(Y^2/R_m)/(1+\sqrt{1-1+K_m)\cdot(Y/R_m)^2})\}+A_1\cdot Y+A_2\cdot Y^2+A_3\cdot Y^3+A_4\cdot Y^4+A_5\cdot Y^5+A_6\cdot Y^6 \quad (9).$$

In the formula (9), when a numerical value other than zero is substituted for coefficients of uneven number $A_1$, $A_3$, $A_5$, . . . , the non-arc shape is asymmetrical in the main scanning direction.

When a curvature changes in the main scanning direction (i.e., in the direction indicated by a Y-coordinate with the optical axis position serving as the origin of coordinates) in the sub-scanning cross section, a curvature in the sub-scanning cross section is expressed by the following formula (10), where $R_s(0)$ represents a radius of curvature on the optical axis in the sub-scanning cross section:

$$C_s(Y)=1/R_s(0)+B_1\cdot Y+B_2\cdot Y^2+B_3\cdot Y^3+B_4\cdot Y^4+B_5\cdot Y^5+B_6\cdot Y^6+ \quad (10)$$

In the formula (10), when a numerical value other than zero is substituted for coefficients of uneven number $B_1$, $B_3$, $B_5$, . . . , the change in the curvature in the sub-scanning cross section is asymmetrical with respect to the main scanning direction.

A sub-non-arc surface is a surface of the non-arch shape in the sub-scanning cross section, that changes according to the position of the sub-scanning cross section in the main scanning direction, and is expressed by the following formula (11), where Y represents a position of the sub-scanning cross section in the main scanning direction and Z represents the coordinate in the sub-scanning direction:

$$\begin{aligned} X = {} & \{(Y^2/R_m)/(1+\sqrt{1-(1+K_m)\cdot(Y/R_m)^2})\} + A_1\cdot Y + A_2\cdot Y^2 + \quad (11)\\ & A_3\cdot Y^3 + A_4\cdot Y^4 + A_5\cdot Y^5 + A_6\cdot Y^6 + \ldots +\\ & (C_s\cdot Z^2)/(1+\sqrt{1-(1+K_5)\cdot(C_s/Z)^2}) +\\ & (F_0+F_1\cdot Y+F_2\cdot Y^2+F_3\cdot Y^3+F_4\cdot Y^4+\ldots)\cdot Z +\\ & (G_0+G_1\cdot Y+G_2\cdot Y^2+G_3\cdot Y^3+G_4\cdot Y^4+\ldots)\cdot Z^2 +\\ & (H_0+H_1\cdot Y+H_2\cdot Y^2+H_3\cdot Y^3+H_4\cdot Y^4+\ldots)\cdot Z^3 +\\ & (I_0+I_1\cdot Y+I_2\cdot Y^2+I_3\cdot Y^3+I_4\cdot Y^4+\ldots)\cdot Z^4 +\\ & (J_0+J_1\cdot Y+J_2\cdot Y^2+J_3\cdot Y^3+J_4\cdot Y^4+\ldots)\cdot Z^5 +\\ & (K_0+K_1\cdot Y+K_2\cdot Y^2+K_3\cdot Y^3+K_4\cdot Y^4+\ldots)\cdot Z^6 +\\ & (L_0+L_1\cdot Y+L_2\cdot Y^2+L_3\cdot Y^3+L_4\cdot Y^4+\ldots)\cdot Z^7 +\\ & (M_0+M_1\cdot Y+M_2\cdot Y^2+M_3\cdot Y^3+M_4\cdot Y^4+\ldots)\cdot Z^8 +\\ & (N_0+N_1\cdot Y+N_2\cdot Y^2+N_3\cdot Y^3+N_4\cdot Y^4+\ldots)\cdot Z^9. \end{aligned}$$

In the formula (11), $C_s(Y)$ defined in the formula (10) is expressed as $C_s$, and $K_s$ is defined by the following formula (12):

$$K_s=K_s(0)+C_1\cdot Y+C_2\cdot Y^2+C_3\cdot Y^3+C_4\cdot Y^4+C_5\cdot Y^5+ \quad (12).$$

In the formula (11), when a numerical value other than zero is substituted for $F_1$, $F_3$, $F_5$, . . . , $G_1$, $G_3$, $G_5$, . . . , etc., the non-arc shape in the sub-scanning cross section is asymmetrical in the main scanning direction. That is, in the formula (11), the first and second lines of the right side is a function of the Y coordinate in the main scanning direction only, and expresses a shape in the main scanning cross section. With respect to the third lines and subsequent lines of the right side of the formula (11), if the Y coordinate in the sub-scanning cross section is determined, the coefficient of each degree of Z is uniquely determined, and the non-arch shape in the sub-scanning cross section on the Y coordinate is defined.

Shapes of lens surfaces can be expressed in various manners, and it is therefore to be understood that the shapes of lens surfaces of the present invention can be expressed otherwise than as expressed above using mathematical formulas.

Figure 5:
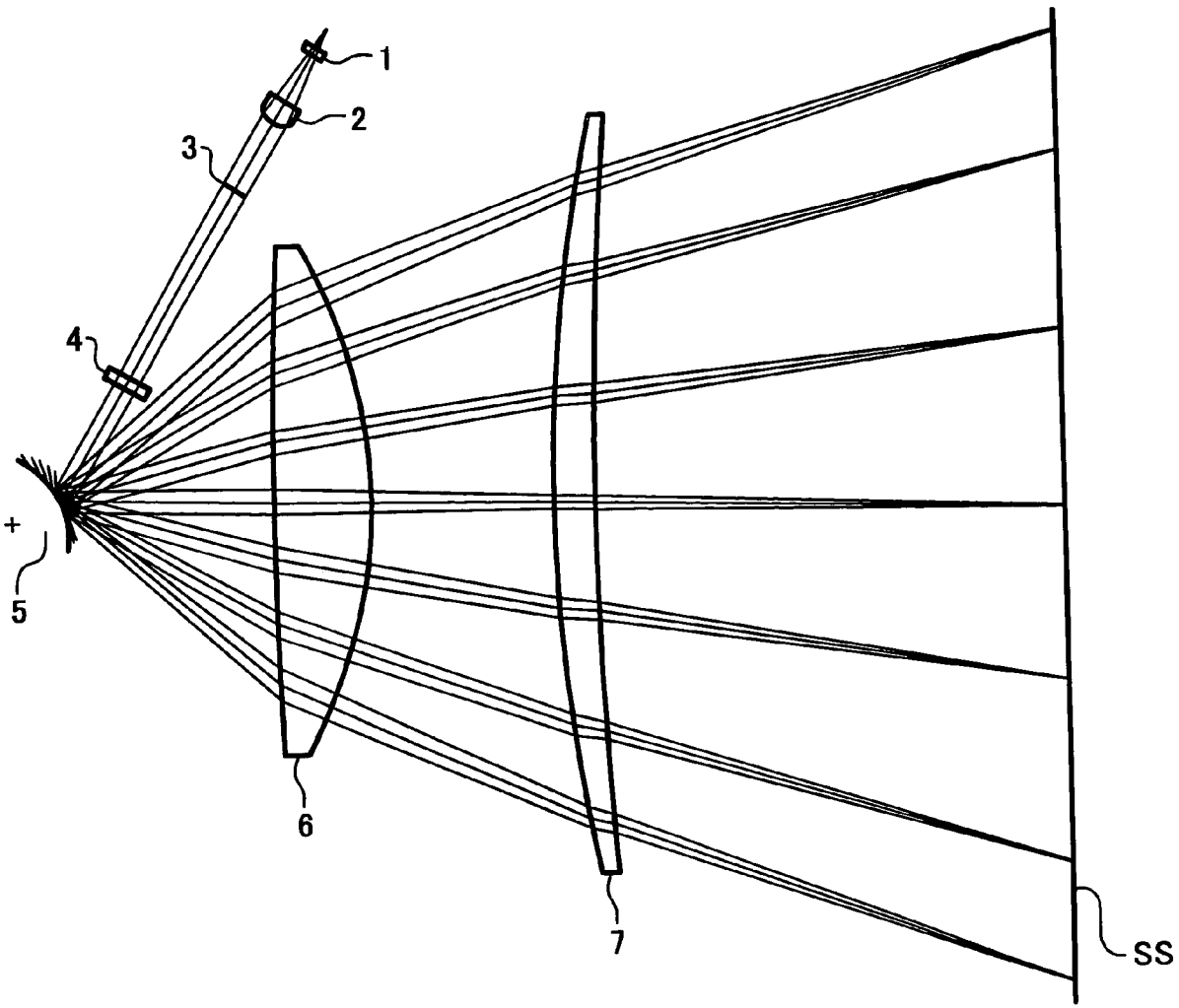
FIG. 5 is a schematic diagram of a scanning optical system of a multi-beam optical scanning apparatus according to the first embodiment of the present invention.

FIG. 5 schematically illustrates the construction of a scanning optical system of a multi-beam optical scanning apparatus according to the first embodiment of the present invention. The scanning optical system is substantially the same as the one of the multi-beam optical scanning apparatus illustrated in FIG. 1. The scanning optical system includes the coupling lens 2, the aperture 3, the cylindrical lens 4, the rotating multi-faced mirror 5, the first image forming lens 6, and the second image forming lens 7. A plurality of laser optical beams emitted from the semiconductor laser array 1 launch onto the rotating multi-faced mirror 5 via the coupling lens 2, the aperture 3, and the cylindrical lens 4, and are then reflected and deflected by the rotating multi-faced mirror 5. The deflected beams are formed into beam spots on a scanning surface SS of the photoconductor 9 via the first image forming lens 6 and the second image forming lens 7. As the rotating multi-faced mirror 5 rotates, the beam spots scan the scanning surface SS.

The construction of the scanning optical system of the multi-beam optical scanning apparatus according to the first embodiment of the present invention is hereinafter described concretely. The semiconductor laser array 1 serving as a light source is constructed as follows:

the number of light emitting sources n: 4 light emitting source pitch $P_{LD}$: 20 $\mu$m wavelength: 670 nm maximum output: 8 mW slanting angle $\gamma$: 29.45° diverging angle: $\theta_{\perp}30°$, $\theta_{\parallel}9°$.

The coupling lens 2 is constructed as follows:

focal length $f_{COL}$: 30 mm (one piece of lens in one group)

coupling function: collimating function distance "d" between the coupling lens 2 and a reflective deflecting surface of the rotating multi-faced mirror 5: 156.98 mm.

The cylindrical lens 4 is constructed as follows:

focal length in the sub-scanning direction: 51.88 mm.

The aperture 3 has an opening formed in a rectangle and the dimensions of the rectangle opening are as follows:

main scanning direction $A_m$: 7.9 mm sub-scanning direction $A_s$: 1.2 mm.

The rotating multi-faced mirror 5 is constructed as follows:

the number of reflective deflecting surfaces: 5 radius of an inscribed circle: 18 mm angle formed by the optical axis of beams launching onto the rotating multi-faced mirror 5 from the side of the semiconductor laser array 1 and the optical axis of the subsequent scanning image forming optical system: 60°.

The photoconductor 9 is constructed such that the condition at the scanning surface SS is as follows:

writing density: 1200 dpi targeted optical spot diameters $\omega_m\times\omega_s$: 30×30 $\mu$m.

Data of the optical system between the rotating multi-faced mirror 5 and the scanning surface SS is indicated in Table 1. Symbol $R_m$ denotes a radius of curvature in the main scanning direction, symbol $R_s$ denotes a radius of curvature in the sub-scanning direction, and symbol n denotes a refractive index. In the following data, the radiuses of curvature $R_m$ and $R_s$ are paraxial radiuses of curvature except for arc shapes.

TABLE 1

| | Surface number | $R_{mi}$ | $R_{si}(0)$ | X | Y | N |
|---|---|---|---|---|---|---|
| Reflective deflecting surface | 0 | ∞ | ∞ | 72.49 | 0.206 | |
| Lens 6 | 1 | 1617.54 | −52 | 35 | 0 | 1.52657 |
| | 2 | −146.53 | −195.27 | 62.91 | 0.003 | |
| Lens 7 | 3 | 413.68 | −71.31 | 13.94 | 0 | 1.52657 |
| | 4 | 824.88 | −27.7 | 160.22 | 0 | |

The coefficients in the main scanning direction and the sub-scanning direction of each surface are indicated in Table 2 through Table 5, and the coefficients in the sub-scanning direction of the emerging surface (the fourth surface) of the second image forming lens 7 are indicated in Table 6.

TABLE 2

| Surface number | Coefficients in the main scanning direction | | Coefficients in the sub-scanning direction | |
|---|---|---|---|---|
| 1 | K | 185 | $B_1$ | $-1.069 \times 10^{-5}$ |
| | $A_1$ | 0 | $B_2$ | $2.323 \times 10^{-6}$ |
| | $A_2$ | 0 | $B_3$ | $2.768 \times 10^{-9}$ |
| | $A_3$ | 0 | $B_4$ | $-2.010 \times 10^{-10}$ |
| | $A_4$ | $1.284 \times 10^{-8}$ | $B_5$ | $-5.286 \times 10^{-13}$ |
| | $A_5$ | 0 | $B_6$ | $1.603 \times 10^{-14}$ |
| | $A_6$ | $-6.017 \times 10^{-13}$ | $B_7$ | $4.005 \times 10^{-17}$ |
| | $A_7$ | 0 | $B_8$ | $-5.616 \times 10^{-19}$ |
| | $A_8$ | $-8.040 \times 10^{-17}$ | $B_9$ | $1.444 \times 10^{-20}$ |
| | $A_9$ | 0 | $B_{10}$ | $-1.834 \times 10^{-21}$ |
| | $A_{10}$ | $5.138 \times 10^{-21}$ | $B_{11}$ | $-2.465 \times 10^{-24}$ |
| | $A_{11}$ | 0 | $B_{12}$ | $1.419 \times 10^{-25}$ |

TABLE 3

| Surface number | Coefficients in the main scanning direction | | Coefficients in the sub-scanning direction | |
|---|---|---|---|---|
| 2 | K | $-1.934 \times 10^{-1}$ | $B_1$ | 0 |
| | $A_1$ | 0 | $B_2$ | $-2.116 \times 10^{-6}$ |
| | $A_2$ | 0 | $B_3$ | 0 |
| | $A_3$ | 0 | $B_4$ | $4.472 \times 10^{-11}$ |
| | $A_4$ | $1.790 \times 10^{-8}$ | $B_5$ | 0 |
| | $A_5$ | 0 | $B_6$ | $3.322 \times 10^{-14}$ |
| | $A_6$ | $2.847 \times 10^{-13}$ | $B_7$ | 0 |
| | $A_7$ | 0 | $B_8$ | $-1.366 \times 10^{-18}$ |
| | $A_8$ | $-3.723 \times 10^{-17}$ | $B_9$ | 0 |
| | $A_9$ | 0 | $B_{10}$ | $-6.548 \times 10^{-22}$ |
| | $A_{10}$ | $5.930 \times 10^{-21}$ | $B_{11}$ | 0 |
| | $A_{11}$ | 0 | $B_{12}$ | $-4.619 \times 10^{-26}$ |

TABLE 4

| Surface number | Coefficients in the main scanning direction | | Coefficients in the sub-scanning direction | |
|---|---|---|---|---|
| 3 | K | −13.95 | $B_1$ | 0 |
| | $A_1$ | 0 | $B_2$ | $-1.958 \times 10^{-7}$ |
| | $A_2$ | 0 | $B_3$ | 0 |
| | $A_3$ | 0 | $B_4$ | $2.316 \times 10^{-11}$ |
| | $A_4$ | $-6.790 \times 10^{-9}$ | $B_5$ | 0 |
| | $A_5$ | 0 | $B_6$ | $-1.140 \times 10^{-15}$ |
| | $A_6$ | $-2.046 \times 10^{-13}$ | $B_7$ | 0 |
| | $A_7$ | 0 | $B_8$ | $1.179 \times 10^{-20}$ |
| | $A_8$ | $7.466 \times 10^{-18}$ | $B_9$ | 0 |
| | $A_9$ | 0 | $B_{10}$ | $9.187 \times 10^{-25}$ |
| | $A_{10}$ | $5.282 \times 10^{-22}$ | $B_{11}$ | 0 |
| | $A_{11}$ | 0 | $B_{12}$ | $-5.552 \times 10^{-29}$ |
| | $A_{12}$ | $-8.143 \times 10^{-27}$ | $B_{13}$ | 0 |
| | $A_{13}$ | 0 | $B_{14}$ | 0 |

TABLE 4-continued

| Surface number | Coefficients in the main scanning direction | | Coefficients in the sub-scanning direction | |
|---|---|---|---|---|
| | $A_{14}$ | $-3.771 \times 10^{-33}$ | $B_{15}$ | 0 |

TABLE 5

| Surface number | Coefficients in the main scanning direction | | Coefficients in the sub-scanning direction | |
|---|---|---|---|---|
| 4 | K | −69.07 | $B_1$ | $-9.030 \times 10^{-7}$ |
| | $A_1$ | 0 | $B_2$ | $4.204 \times 10^{-7}$ |
| | $A_2$ | 0 | $B_3$ | $-2.211 \times 10^{-11}$ |
| | $A_3$ | 0 | $B_4$ | $-3.115 \times 10^{-11}$ |
| | $A_4$ | $-1.348 \times 10^{-8}$ | $B_5$ | $1.857 \times 10^{-15}$ |
| | $A_5$ | 0 | $B_6$ | $1.289 \times 10^{-15}$ |
| | $A_6$ | $8.953 \times 10^{-14}$ | $B_7$ | $-1.444 \times 10^{-19}$ |
| | $A_7$ | 0 | $B_8$ | $3.211 \times 10^{-21}$ |
| | $A_8$ | $1.936 \times 10^{-17}$ | $B_9$ | $2.173 \times 10^{-23}$ |
| | $A_9$ | 0 | $B_{10}$ | $-9.827 \times 10^{-25}$ |
| | $A_{10}$ | $-2.840 \times 10^{-22}$ | $B_{11}$ | $-9.598 \times 10^{-28}$ |
| | $A_{11}$ | 0 | $B_{12}$ | $-1.663 \times 10^{-29}$ |
| | $A_{12}$ | $6.044 \times 10^{-27}$ | $B_{13}$ | 0 |
| | $A_{13}$ | 0 | $B_{14}$ | 0 |
| | $A_{14}$ | $1.077 \times 10^{-31}$ | $B_{15}$ | 0 |

TABLE 6

| | | | | | | |
|---|---|---|---|---|---|---|
| 4 | $C_0$ | −1.000 | $I_0$ | $-8.009 \times 10^{-7}$ | $K_0$ | $-1.179 \times 10^{-9}$ |
| | $C_1$ | 0 | $I_1$ | $-8.846 \times 10^{-11}$ | $K_1$ | $-9.850 \times 10^{-13}$ |
| | $C_2$ | 0 | $I_2$ | $7.158 \times 10^{-11}$ | $K_2$ | $-9.672 \times 10^{-14}$ |
| | $C_3$ | 0 | $I_3$ | $-1.870 \times 10^{-13}$ | $K_3$ | $1.828 \times 10^{-15}$ |
| | $C_4$ | 0 | $I_4$ | $-2.617 \times 10^{-14}$ | $K_4$ | $1.860 \times 10^{-16}$ |
| | $C_5$ | 0 | $I_5$ | $6.722 \times 10^{-17}$ | $K_5$ | $-6.285 \times 10^{-19}$ |
| | $C_6$ | 0 | $I_6$ | $5.872 \times 10^{-18}$ | $K_6$ | $-5.428 \times 10^{-20}$ |
| | $C_7$ | 0 | $I_7$ | $-9.322 \times 10^{-21}$ | $K_7$ | $8.632 \times 10^{-23}$ |
| | $C_8$ | 0 | $I_8$ | $-6.141 \times 10^{-22}$ | $K_8$ | $6.187 \times 10^{-24}$ |
| | $C_9$ | 0 | $I_9$ | $5.471 \times 10^{-25}$ | $K_9$ | $-5.030 \times 10^{-27}$ |
| | $C_{10}$ | 0 | $I_{10}$ | $2.868 \times 10^{-26}$ | $K_{10}$ | $-3.015 \times 10^{-28}$ |
| | $C_{11}$ | 0 | $I_{11}$ | $-1.116 \times 10^{-29}$ | $K_{11}$ | $1.019 \times 10^{-31}$ |
| | $C_{12}$ | 0 | $I_{12}$ | $-4.938 \times 10^{-31}$ | $K_{12}$ | $5.340 \times 10^{-33}$ |

The numerical values of parameters in the scanning optical system of the above-described first embodiment are as follows:

$L_m$: 9.09 mm $L_s$: 14.47 mm

β: 0.7

$D_m$: 25.74 mm

δ: 0.12 mm

W: 300 mm

Δ: 0.08 mm

θ: 15.770

α: 1.217.

From the above, the conditional formula (3) is satisfied as follows:

$$\{\beta \times P_{LD} \times \sin\gamma \times (n-1) \times ((d - f_{COL}) / f_{COL})\} / \omega_s =$$
$$\{0.7 \times (20 \times 10^{-3}) \times \sin 29.45^\circ \times (4-1) \times ((156.98 - 30)/30)\} / 30 \times 10^{-3} =$$
$$2.91.$$

Also, the conditional formula (4) is satisfied as follows:

$$(D_m \times \omega_m)/(\delta \times W) = (25.74 \times (30 \times 10^{-3}))/(0.12 \times 300)$$
$$= 2.06 \times 10^{-2}.$$

The conditional formula (5) is also satisfied as follows:

$$P_{LD}\times(n-1)\times\alpha\times(\cos(\gamma-1)-\cos\gamma)\times\mathrm{dpi}/25.4-(20\times10^{-3})\times(4-1)\times 1.217\times(\cos(29.45^{\circ}-1^{\circ})-\cos29.45^{\circ})\times1200/25.4=0.0291.$$

Further, because the conditional formula (6) is satisfied as follows, a method of obtaining a synchronization signal from one of the plurality of optical beams can be adopted:

$$\Delta\times(\cos(\theta-1)-\cos\theta)\times dpi/25.4=0.08\times(\cos(15.77^{\circ}\ 1^{\circ})-\cos 15.77^{\circ})\times1200/25.4=0.0169.$$

Figure 6A:
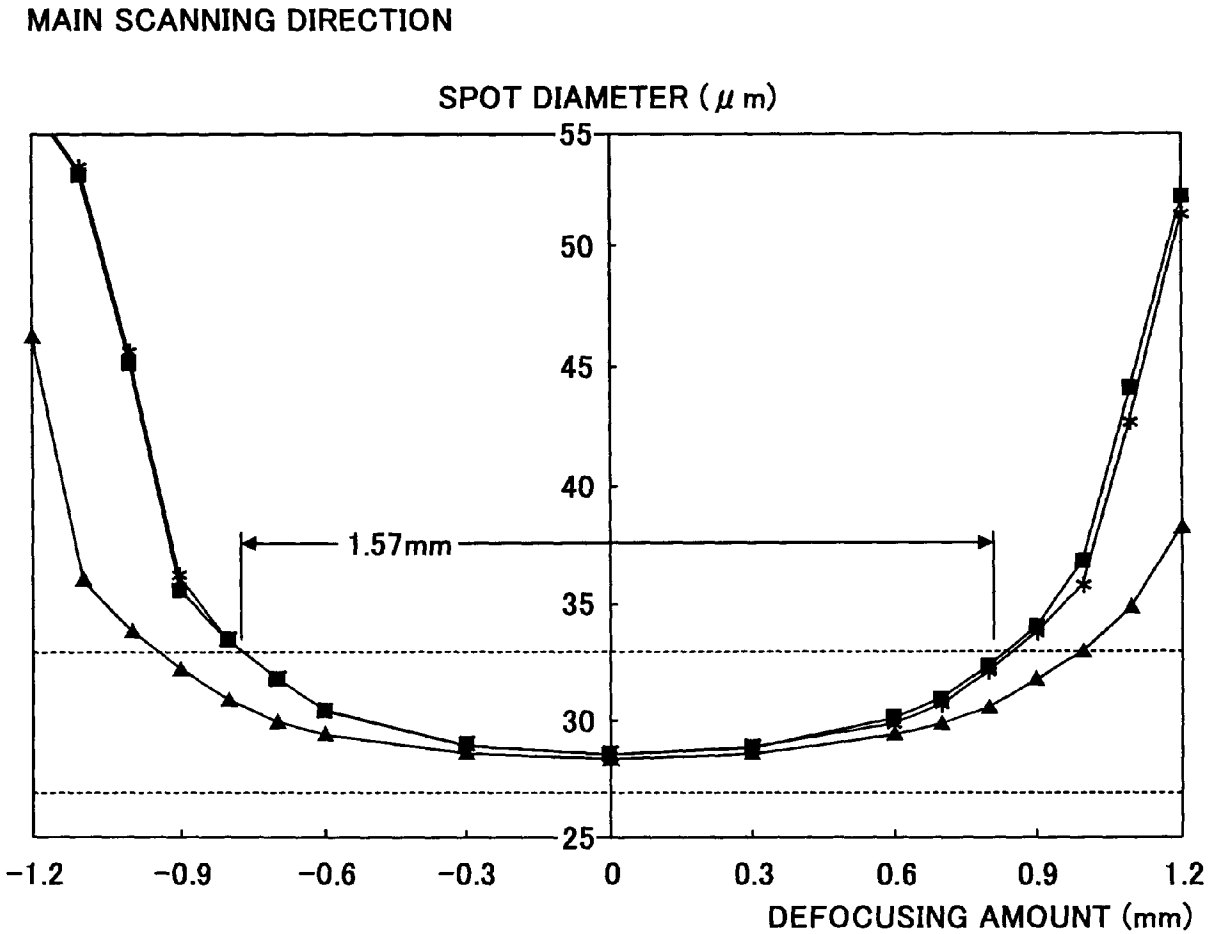
FIG. 6A is a graph illustrating a depth curve with respect to the main scanning direction for each image height of an optical spot diameter of an optical spot in the multi-beam optical scanning apparatus of FIG. 5.
Figure 6B:
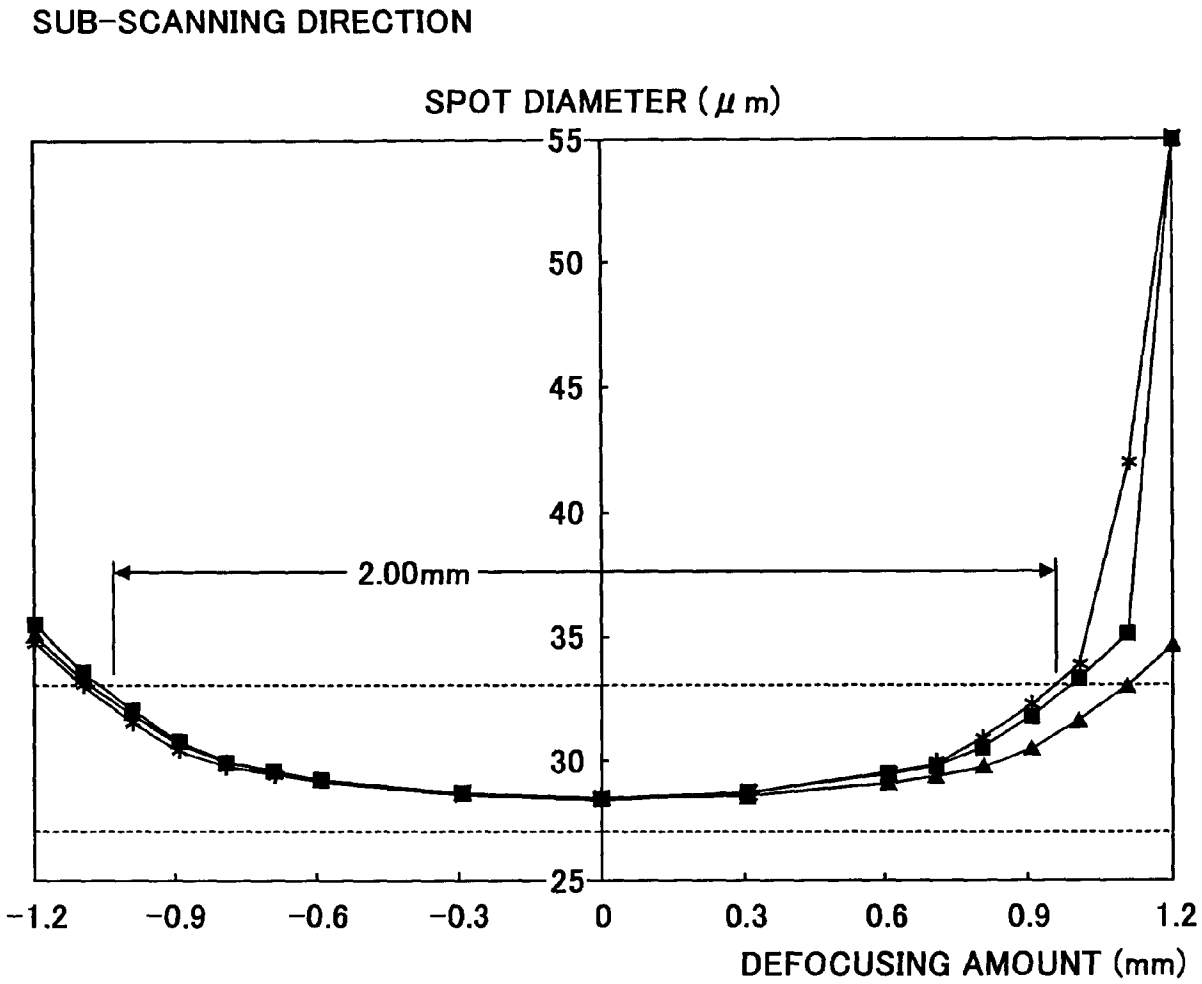
FIG. 6B is a graph illustrating a depth curve with respect to the sub-scanning direction for each image height of an optical spot diameter of an optical spot in the multi-beam optical scanning apparatus of FIG. 5.

FIG. 6A and FIG. 6B illustrate depth curves of optical spot diameters with respect to the main scanning and sub-scanning directions of an optical spot corresponding to the light emitting source ch1 of the semiconductor laser array 1. The depth curves are illustrated for three image height positions, the central position and two peripheral positions, respectively. As illustrated in FIG. 6A and FIG. 6B, a satisfactory depth is obtained with respect to both of the main scanning direction and the sub-scanning direction of the optical spot, so that a tolerance relative to a positional accuracy of the scanning surface SS is relatively large. When the photoconductor 9 having the exposure energy of 6.3 $mJ/m^2$ is used, the maximum light emitting output of the semiconductor laser array 1 is 7.22 mW (<8 mW), which is sufficient as the light quantity.

Figure 7:
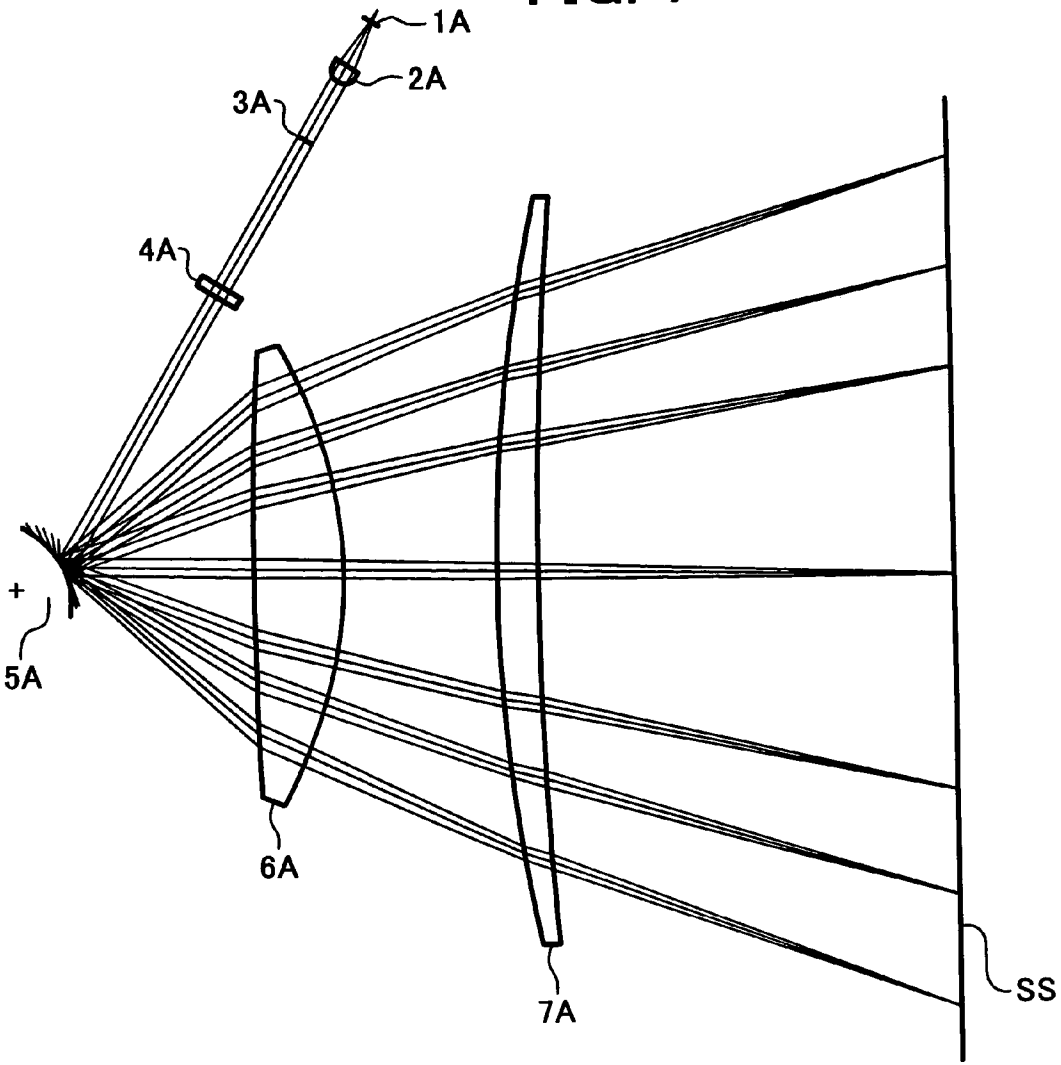
FIG. 7 is a schematic diagram of a scanning optical system of a multi-beam optical scanning apparatus according to the second embodiment of the present invention.

FIG. 7 schematically illustrates the construction of a scanning optical system of the multi-beam optical scanning apparatus of FIG. 1, according to the second embodiment of the present invention. The scanning optical system includes a coupling lens 2A, an aperture 3A, a cylindrical lens 4A, a rotating multi-faced mirror 5A, a first image forming lens 6A, and a second image forming lens 7A, which respectively correspond to the coupling lens 2, the aperture 3, the cylindrical lens 4, the rotating multi-faced mirror 5, the first image forming lens 6, and the second image forming lens 7 in FIG. 1. A plurality of laser optical beams emitted from the semiconductor laser array 1A launch onto the rotating multi-faced mirror 5A via the coupling lens 2A, the aperture 3A, and the cylindrical lens 4A, and are then reflected and deflected by the rotating multi-faced mirror 5A. The deflected beams are formed into beam spots on the scanning surface SS of the photoconductor 9A via the first image forming lens 6A and the second image forming lens 7A. As the rotating multi-faced mirror 5A rotates, the beam spots scan the scanning surface SS.

The construction of the scanning optical system of the multi-beam optical scanning apparatus according to the second embodiment of the present invention is hereinafter described concretely.

The semiconductor laser array 1A is constructed as follows:

the number of light emitting sources n: 4 light emitting source pitch $P_{LD}$: 14 $\mu$m wavelength: 780 nm maximum output: 10 mW slanting angle $\gamma$: 62.3° diverging angle: $\theta_{\perp}30°$, $\theta_{\parallel}9°$

The coupling lens 2A is constructed as follows:

focal length $f_{COL}$: 27 mm (one piece of lens in one group)

coupling function: collimating function distance "d" between the coupling lens 2A and a reflective deflecting surface of the rotating multi-faced mirror 5A: 220.8 mm.

The cylindrical lens 4A is constructed as follows:

focal length in the sub-scanning direction: 126.18 mm.

The aperture 3A has an opening formed in an ellipse, and the dimensions of the opening are as follows:

main scanning direction $A_m$: 6.56 mm sub-scanning direction $A_s$: 2.3 mm.

The rotating multi-faced mirror 5A is constructed as follows:

the number of reflective deflecting surfaces: 5 radius of an inscribed circle: 18 mm angle formed by the optical axis of beams launching onto the rotating multi-faced mirror 5A from the side of the semiconductor laser array 1A and the optical axis of the subsequent scanning image forming optical system: 60°.

The photoconductor 9A is constructed such that the condition at the scanning surface SS is as follows:

writing density: 1200 dpi targeted optical spot diameter: 45 $\mu$m.

Data of the optical system between the rotating multi-faced mirror 5A and the scanning surface SS is indicated in Table 7.

TABLE 7

| | Surface number | $R_{mi}$ | $R_{si}(0)$ | X | Y | N |
|---|---|---|---|---|---|---|
| Reflective deflecting surface | 0 | ∞ | ∞ | 72.56 | 0.286 | |
| Lens 6A | 1 | 1616.43 | −50.14 | 35 | 0 | 1.52398 |
| | 2 | −146.51 | −199.81 | 61.93 | 0.033 | |
| Lens 7A | 3 | 400.87 | −72.03 | 14 | 0 | 1.52398 |
| | 4 | 824.88 | −27.59 | 160.56 | 0 | |

The coefficients in the main scanning direction and the sub-scanning direction of each surface are indicated in Table 8 through Table 11, and the coefficients in the sub-scanning direction of the emerging surface (the fourth surface) of the second image forming lens 7A are indicated in Table 12.

TABLE 8

| Surface number | Coefficients in the main scanning direction | | Coefficients in the sub-scanning direction | |
|---|---|---|---|---|
| 1 | K | $1976\times10^{-2}$ | $B_1$ | $-1.162\times10^{-5}$ |
| | $A_1$ | 0 | $B_2$ | $2.276\times10^{-6}$ |
| | $A_2$ | 0 | $B_3$ | $2.714\times10^{-9}$ |
| | $A_3$ | 0 | $B_4$ | $-1.544\times10^{-10}$ |
| | $A_4$ | $1.281\times10^{-8}$ | $B_5$ | $-4.265\times10^{-13}$ |
| | $A_5$ | 0 | $B_6$ | $6.417\times10^{-15}$ |
| | $A_6$ | $-6.374\times10^{-13}$ | $B_7$ | $9.179\times10^{-19}$ |
| | $A_7$ | 0 | $B_8$ | $-1.230\times10^{-19}$ |
| | $A_8$ | $-9.428\times10^{-17}$ | $B_9$ | $1.453\times10^{-20}$ |
| | $A_9$ | 0 | $B_{10}$ | $-1.881\times10^{-22}$ |
| | $A_{10}$ | $5.965\times10^{-21}$ | $B_{11}$ | $-1.468\times10^{-24}$ |
| | $A_{11}$ | 0 | $B_{12}$ | $-2.670\times10^{-26}$ |

TABLE 9

| Surface number | Coefficients in the main scanning direction | | Coefficients in the sub-scanning direction | |
|---|---|---|---|---|
| 2 | K | $-1.857\times10^{-1}$ | $B_1$ | 0 |
| | $A_1$ | 0 | $B_2$ | $-2.125\times10^{-6}$ |
| | $A_2$ | 0 | $B_3$ | 0 |
| | $A_3$ | 0 | $B_4$ | $1.805\times10^{-11}$ |
| | $A_4$ | $1.774\times10^{-8}$ | $B_5$ | 0 |
| | $A_5$ | 0 | $B_6$ | $2.716\times10^{-14}$ |
| | $A_6$ | $1.384\times10^{-13}$ | $B_7$ | 0 |
| | $A_7$ | 0 | $B_8$ | $6.924\times10^{-19}$ |

TABLE 9-continued

| Surface number | Coefficients in the main scanning direction | | Coefficients in the sub-scanning direction | |
|---|---|---|---|---|
| | $A_8$ | $-4.354 \times 10^{-17}$ | $B_9$ | 0 |
| | $A_9$ | 0 | $B_{10}$ | $-2.685 \times 10^{-22}$ |
| | $A_{10}$ | $7.168 \times 10^{-21}$ | $B_{11}$ | 0 |
| | $A_{11}$ | 0 | $B_{12}$ | $-5.778 \times 10^{-28}$ |

TABLE 10

| Surface number | Coefficients in the main scanning direction | | Coefficients in the sub-scanning direction | |
|---|---|---|---|---|
| 3 | K | −12.60 | $B_1$ | 0 |
| | $A_1$ | 0 | $B_2$ | $-1.962 \times 10^{-7}$ |
| | $A_2$ | 0 | $B_3$ | 0 |
| | $A_3$ | 0 | $B_4$ | $2.230 \times 10^{-11}$ |
| | $A_4$ | $-7.349 \times 10^{-9}$ | $B_5$ | 0 |
| | $A_5$ | 0 | $B_6$ | $-1.022 \times 10^{-15}$ |
| | $A_6$ | $-2.106 \times 10^{-13}$ | $B_7$ | 0 |
| | $A_7$ | 0 | $B_8$ | $1.081 \times 10^{-20}$ |
| | $A_8$ | $8.173 \times 10^{-18}$ | $B_9$ | 0 |
| | $A_9$ | 0 | $B_{10}$ | $6.363 \times 10^{-25}$ |
| | $A_{10}$ | $5.409 \times 10^{-22}$ | $B_{11}$ | 0 |
| | $A_{11}$ | 0 | $B_{12}$ | $-3.645 \times 10^{-29}$ |
| | $A_{12}$ | $-1.082 \times 10^{-26}$ | $B_{13}$ | 0 |
| | $A_{13}$ | 0 | $B_{14}$ | 0 |
| | $A_{14}$ | $-2.039 \times 10^{-32}$ | $B_{15}$ | 0 |

TABLE 11

| Surface number | Coefficients in the main scanning direction | | Coefficients in the sub-scanning direction | |
|---|---|---|---|---|
| 4 | K | −71.068 | $B_1$ | $-8.546 \times 10^{-7}$ |
| | $A_1$ | 0 | $B_2$ | $4.161 \times 10^{-7}$ |
| | $A_2$ | 0 | $B_3$ | $-2.523 \times 10^{-11}$ |
| | $A_3$ | 0 | $B_4$ | $-2.960 \times 10^{-11}$ |
| | $A_4$ | $-1.324 \times 10^{-8}$ | $B_5$ | $2.114 \times 10^{-16}$ |
| | $A_5$ | 0 | $B_6$ | $1.160 \times 10^{-15}$ |
| | $A_6$ | $9.662 \times 10^{-14}$ | $B_7$ | $4.372 \times 10^{-22}$ |
| | $A_7$ | 0 | $B_8$ | $-1.098 \times 10^{-21}$ |
| | $A_8$ | $1.888 \times 10^{-17}$ | $B_9$ | $5.560 \times 10^{-24}$ |
| | $A_9$ | 0 | $B_{10}$ | $-7.785 \times 10^{-25}$ |
| | $A_{10}$ | $-3.102 \times 10^{-22}$ | $B_{11}$ | $-1.617 \times 10^{-29}$ |
| | $A_{11}$ | 0 | $B_{12}$ | $3.262 \times 10^{-30}$ |
| | $A_{12}$ | $7.298 \times 10^{-27}$ | $B_{13}$ | 0 |
| | $A_{13}$ | 0 | $B_{14}$ | 0 |
| | $A_{14}$ | $2.305 \times 10^{-31}$ | $B_{15}$ | 0 |

TABLE 12

| | | | | | | |
|---|---|---|---|---|---|---|
| 4 | $C_0$ | $-3.940 \times 10^{-1}$ | $I_0$ | $2.869 \times 10^{-6}$ | $K_0$ | $-1.526 \times 10^{-9}$ |
| | $C_1$ | $1.796 \times 10^{-4}$ | $I_1$ | $4.012 \times 10^{-11}$ | $K_1$ | $-3.101 \times 10^{-11}$ |
| | $C_2$ | $2.425 \times 10^{-6}$ | $I_2$ | $1.690 \times 10^{-11}$ | $K_2$ | $-8.903 \times 10^{-12}$ |
| | $C_3$ | $4.438 \times 10^{-8}$ | $I_3$ | $3.572 \times 10^{-14}$ | $K_3$ | $5.017 \times 10^{-14}$ |
| | $C_4$ | $4.584 \times 10^{-10}$ | $I_4$ | $-8.742 \times 10^{-15}$ | $K_4$ | $3.241 \times 10^{-15}$ |
| | $C_5$ | $-2.438 \times 10^{-12}$ | $I_5$ | $1.964 \times 10^{-18}$ | $K_5$ | $-7.703 \times 10^{-18}$ |
| | $C_6$ | $-3.396 \times 10^{-14}$ | $I_6$ | $8.603 \times 10^{-19}$ | $K_6$ | $-4.104 \times 10^{-19}$ |
| | $C_7$ | $4.132 \times 10^{-17}$ | $I_7$ | $6.160 \times 10^{-23}$ | $K_7$ | $5.118 \times 10^{-22}$ |
| | $C_8$ | $6.805 \times 10^{-19}$ | $I_8$ | $-3.347 \times 10^{-23}$ | $K_8$ | $2.368 \times 10^{-23}$ |
| | $C_9$ | 0 | $I_9$ | $-3.693 \times 10^{-28}$ | $K_9$ | $-1.550 \times 10^{-26}$ |
| | $C_{10}$ | 0 | $I_{10}$ | $4.536 \times 10^{-28}$ | $K_{10}$ | $-6.371 \times 10^{-28}$ |
| | $C_{11}$ | 0 | $I_{11}$ | 0 | $K_{11}$ | $1.748 \times 10^{-31}$ |
| | $C_{12}$ | 0 | $I_{12}$ | 0 | $K_{12}$ | $6.503 \times 10^{-33}$ |

The numerical values of parameters in the scanning optical system of the above-described second embodiment are as follows:

$L_m$: 13.55 mm $L_s$: 8.06 mm

β: 0.697

$D_m$: 25.4 mm

δ: 0.27 mm

W: 300 mm

Δ: 0.11 mm

θ: 11.48°

α: 3.258.

From the above, the above-described conditional formula (2) is satisfied as follows:

$$L_s/L_m=8.06/13.55=0.595,\ A_s/A_m=2.3/6.56=0.351.$$

Also, the conditional formula (3) is satisfied as follows:

$$\{\beta \times P_{LD} \times \sin\gamma \times (n-1) \times ((d - f_{COL})/f_{COL})\}/\omega_s = \{0.697 \times (14 \times 10^{-3}) \times \sin 62.3^\circ \times (4-1) \times ((220.8-27)/27)\}/45 \times 10^{-3} = 4.14.$$

Also, the conditional formula (4) is satisfied as follows:

$$(D_m \times \omega_m)/(\delta \times W) = (25.4 \times (45 \times 10^{-3}))/(0.27 \times 300) = 1.43 \times 10^{-2}.$$

The conditional formula (5) is also satisfied as follows:

$$P_{LD} \times (n-1) \times \alpha \times (\cos(\gamma - 1) - \cos\gamma) \times \mathrm{dpi}/25.4 = (14 \times 10^{-3}) \times (4-1) \times 3.258 \times (\cos(62.3^\circ - 1^\circ) - \cos 62.3^\circ) \times 1200/25.4 = 0.0994.$$

Further, because the conditional formula (6) is satisfied as follows, a method of obtaining a synchronization signal from one of the plurality of optical beams can be adopted:

$$\Delta \times (\cos(\theta - 1) - \cos\theta) \times dpi/25.4 = 0.11 \times (\cos(11.48^\circ - 1^\circ) - \cos 11.48^\circ) \times 1200/25.4 = 0.0173.$$

Figure 8A:
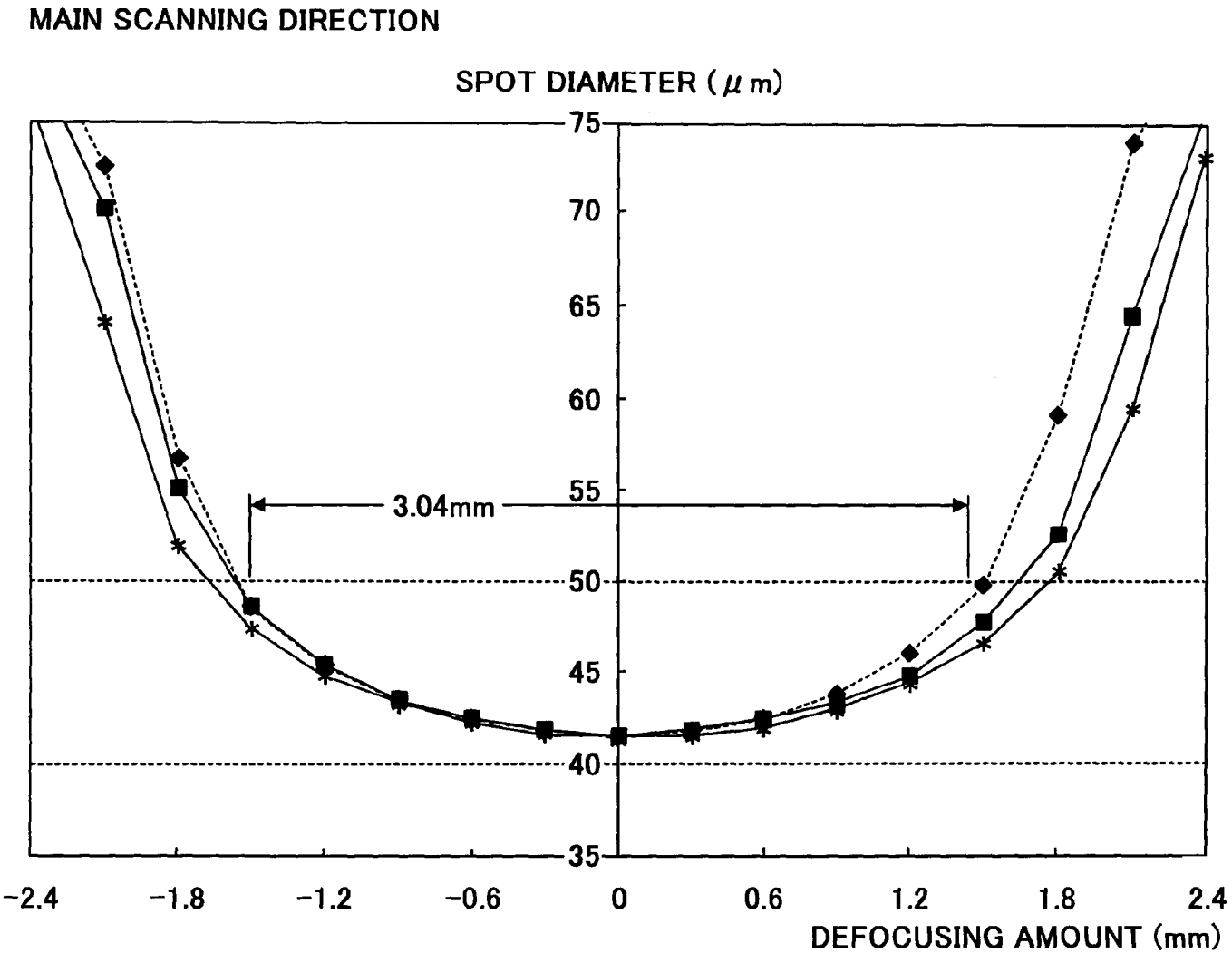
FIG. 8A is a graph illustrating a depth curve with respect to the main scanning direction for each image height of an optical spot diameter of an optical spot in the multi-beam optical scanning apparatus of FIG. 7.
Figure 8B:
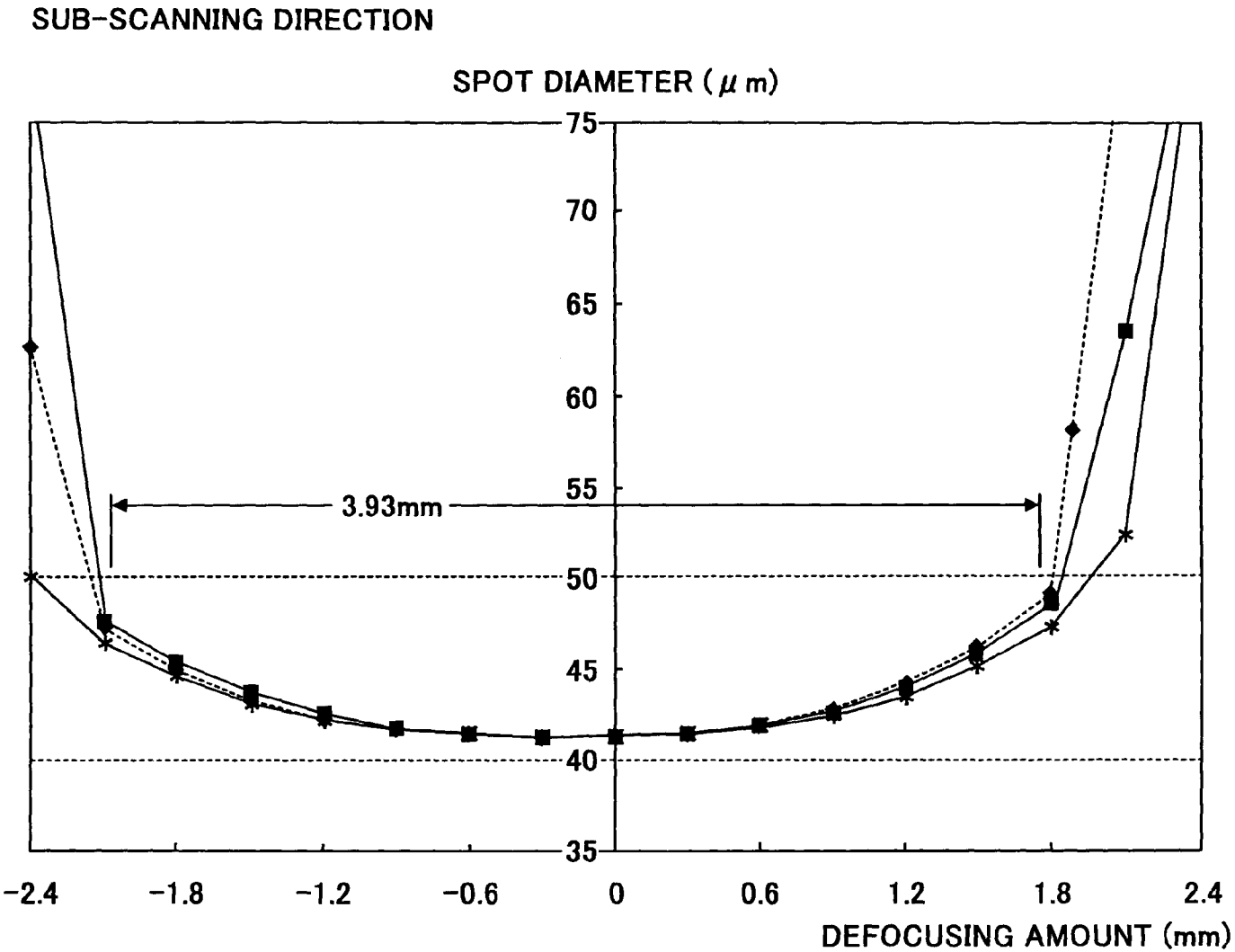
FIG. 8B is a graph illustrating a depth curve with respect to the sub-scanning direction for each image height of an optical spot diameter of an optical spot in the multi-beam optical scanning apparatus of FIG. 7.

FIG. 8A and FIG. 8B illustrate depth curves with respect to the main scanning and sub-scanning directions of an optical spot diameter of an optical spot corresponding to the light emitting source ch1 of the semiconductor laser array 1A. The depth curves are illustrated for three image height positions, the central position and two peripheral positions, respectively. As illustrated in FIG. 8A and FIG. 8B, because the effect of a variation in the diverging angles of the semiconductor laser array 1A is relatively small, a satisfactory depth is obtained with respect to both of the main scanning direction and the sub-scanning direction of the optical spot, so that a tolerance relative to a positional accuracy of the scanning surface SS is relatively large. When the photoconductor 9A having the exposure energy of 6.3 $mJ/m^2$ is used, the maximum light emitting output of the semiconductor laser array 1A is 7.40 mW (<10 mW), which is sufficient as the light quantity.

Figure 9:
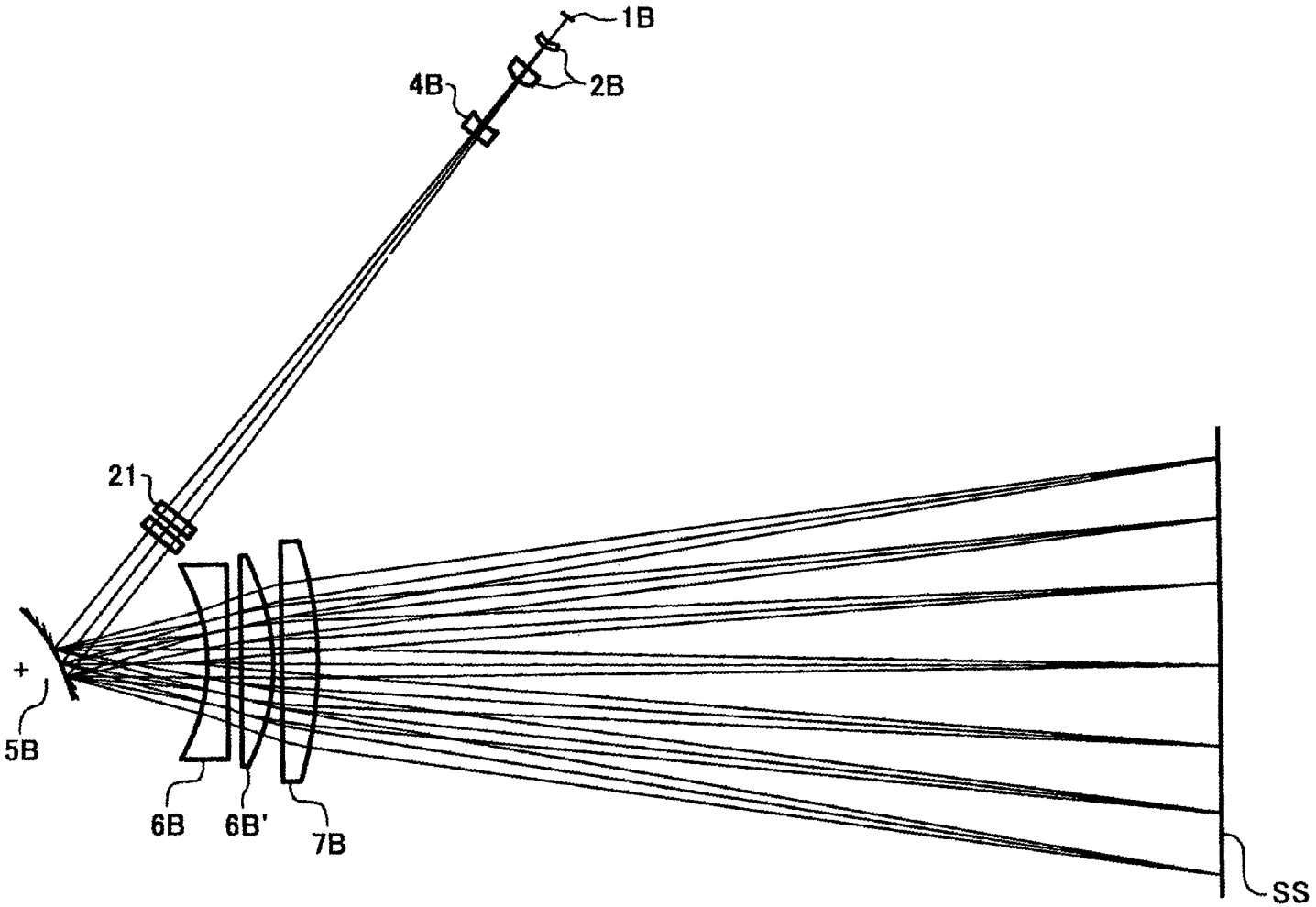
FIG. 9 is a schematic diagram of a scanning optical system of a multi-beam optical scanning apparatus according to the third embodiment of the present invention.

FIG. 9 schematically illustrates the construction of a scanning optical system of the multi-beam optical scanning apparatus of FIG. 1, according to the third embodiment of the present invention. The scanning optical system includes a coupling lens 2B, a cylindrical lens 4B, a rotating multi-faced mirror 5B, a first image forming lens 6B, 6B', and a second image forming lens 7B, which respectively correspond to the coupling lens 2, the cylindrical lens 4, the rotating multi-faced mirror 5, the first image forming lens 6, and the second image forming lens 7 in FIG. 1. The scanning optical system further includes a beam expansion optical system 21 for the main scanning direction between the cylindrical lens 4B and the rotating multi-faced mirror 5B. A plurality of laser beams emitted from the semiconductor laser array 1B launch onto the rotating multi-faced mirror 5B via the coupling lens 2B, the aperture 3B (not illustrated in FIG. 9), the cylindrical lens 4B, and the beam expansion optical system 21, and are then reflected and deflected by the rotating multi-faced mirror 5B. The deflected beams are formed into beam spots on the scanning surface SS of the photoconductor 9B via the first image forming lens 6B, 6B' and the second image forming lens 7B. As the rotating multi-faced mirror 5B rotates, the beam spots scan the scanning surface SS.

The construction of the scanning optical system of the multi-beam optical scanning apparatus according to the third embodiment of the present invention is hereinafter described concretely.

The semiconductor laser array 1B is constructed as follows:

the number of light emitting sources n: 4 light emitting source pitch $P_{LD}$: 10 $\mu$m wavelength: 780 nm maximum output: 10 mW slanting angle $\gamma$: 81.14° diverging angle: $\theta_{\perp}$30°, $\theta_{\parallel}$9°.

The coupling lens 2B is constructed as follows:

focal length $f_{COL}$: 35 mm (three pieces of lens in two groups)

coupling function: diverging function distance "d" between the coupling lens 2B and a reflective deflecting surface of the rotating multi-faced mirror 5B: 558.55 mm.

The cylindrical lens 4B is constructed as follows:

focal length in the sub-scanning direction: 149.43 mm.

The beam expansion optical system 21 is constructed as follows;

expansion magnification; 10.

The aperture 3B has an opening formed in an ellipse, and the dimensions of the opening are as follows:

main scanning direction $A_m$: 2.04 mm sub-scanning direction $A_s$: 17.4 mm.

The rotating multi-faced mirror 5B is constructed as follows:

the number of reflective deflecting surfaces: 8 radius of an inscribed circle: 75 mm angle formed by the optical axis of beams launching onto the rotating multi-faced mirror 5B from the side of the semiconductor laser array 1B and the optical axis of the subsequent scanning image forming optical system: 50°.

The photoconductor 9B is constructed such that the condition at the scanning surface SS is as follows:

writing density: 1200 dpi targeted optical spot diameter: 35 $\mu$m.

Data of the optical system between the rotating multi-faced mirror 5B and the scanning surface SS is indicated in Table 13.

TABLE 13

| | Surface number | $R_{mi}$ | $R_{si}(0)$ | X | Y | n |
|---|---|---|---|---|---|---|
| Reflective deflecting surface | 0 | ∞ | ∞ | 108 | 3.18 | |
| Lens 6B | 1 | −126 | (spherical) | 13.1 | 0 | 1.58201 |
| | 2 | ∞ | 142.95 | 10.6 | 0 | |
| Lens 6B' | 3 | −2450 | (spherical) | 22.5 | 0 | 1.49282 |
| | 4 | −150 | (spherical) | 5.6 | 0 | |

TABLE 13-continued

| | Surface number | $R_{mi}$ | $R_{si}(0)$ | X | Y | n |
|---|---|---|---|---|---|---|
| Lens 7C | 5 | ∞ | ∞ | 27 | 0 | 1.70400 |
| | 6 | −294 | −81.1 | 655.1 | 0 | |

The numerical values of parameters in the scanning optical system of the above-described third embodiment are as follows:

$L_m$: 28.48 mm $L_s$: 9.46 mm $\beta$: 3.228

$D_m$: 61.2 mm $\delta$: 0.54 mm

W: 300 mm $\Delta$: 0.08 mm $\theta$: 51.54°

$\alpha$: 13.784.

From the above, the above-described conditional formula (3) is satisfied as follows:

$$\{\beta\times P_{LD}\times\sin\gamma\times(n-1)\times((d-f_{COL})/f_{COL})\}/\omega_s=\{3.228\times(10\times10^{-3})\times\sin81.14^{\circ}\times(4-1)\times(558.55-35)/35)\}/35\times10^{-3}=40.9.$$

also, the conditional formula (4) is satisfied as follows:

$$(D_m\times\omega_m)/(\delta\times W)=(61.2\times(35\times10^{-3}))/(0.54\times300)=1.32\times10^{-2}.$$

The conditional formula (5) is also satisfied as follows:

$$P_{LD}\times(n-1)\times\alpha\times(\cos(\gamma-1)-\cos\gamma)\times\mathrm{dpi}/25.4=(10\times10^{-3})\times(4-1)\times13.784\times(\cos(81.14^{\circ}-1^{\circ})-\cos81.14^{\circ})\times1200/25.4=0.336.$$

Further, because the conditional formula (6) is satisfied as follows, a method of obtaining a synchronization signal from one of the plurality of optical beams can be adopted:

$$\Delta\times(\cos(\theta-1)-\cos\theta)\times dpi/25.4=0.08\times(\cos(51.54^{\circ}-1^{\circ})-\cos 51.54^{\circ})\times1200/25.4=0.0519.$$

Figure 10A:
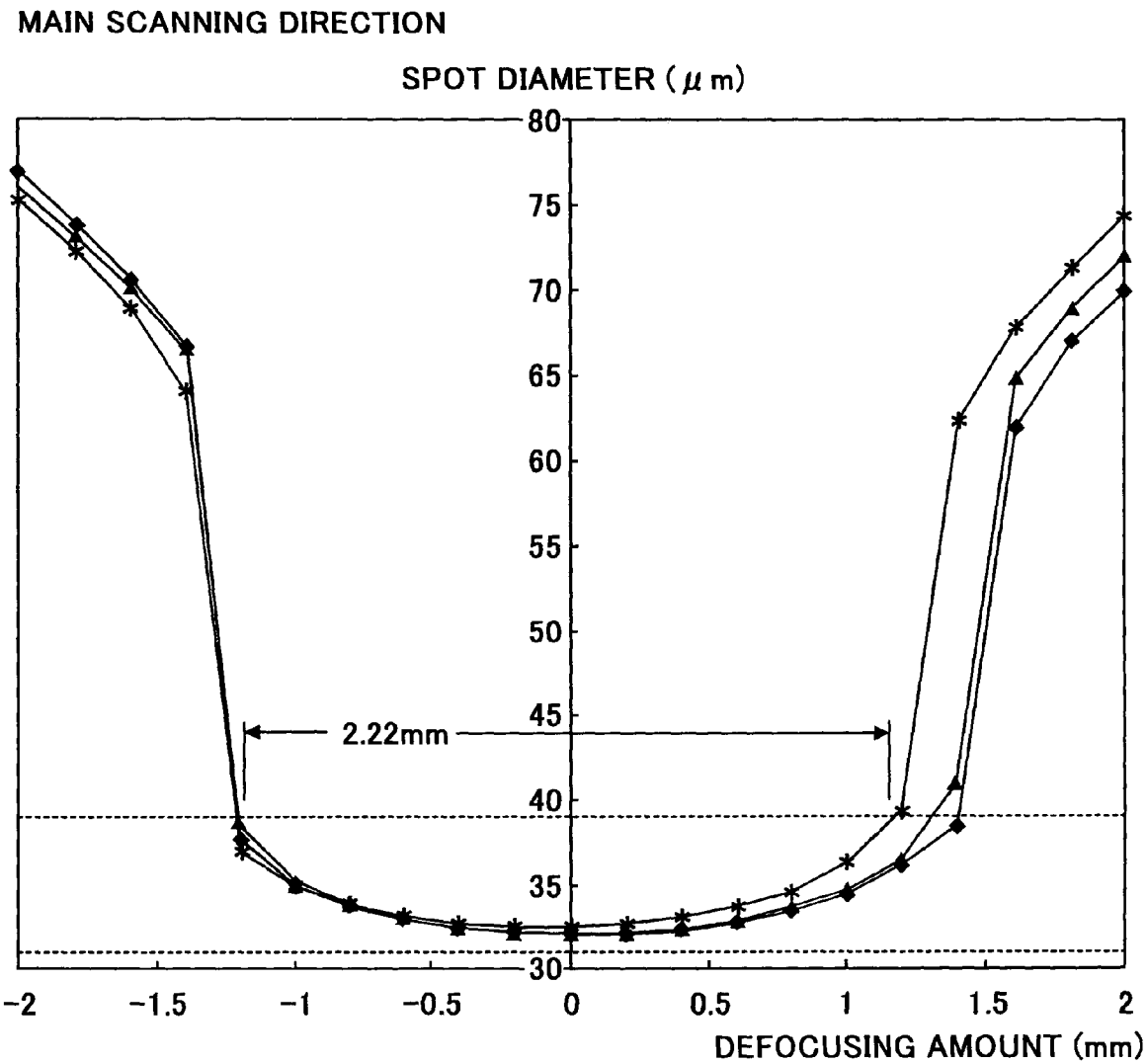
FIG. 10A is a graph illustrating a depth curve with respect to the main scanning direction for each image height of an optical spot diameter of an optical spot in the multi-beam optical scanning apparatus of FIG. 9.
Figure 10B:
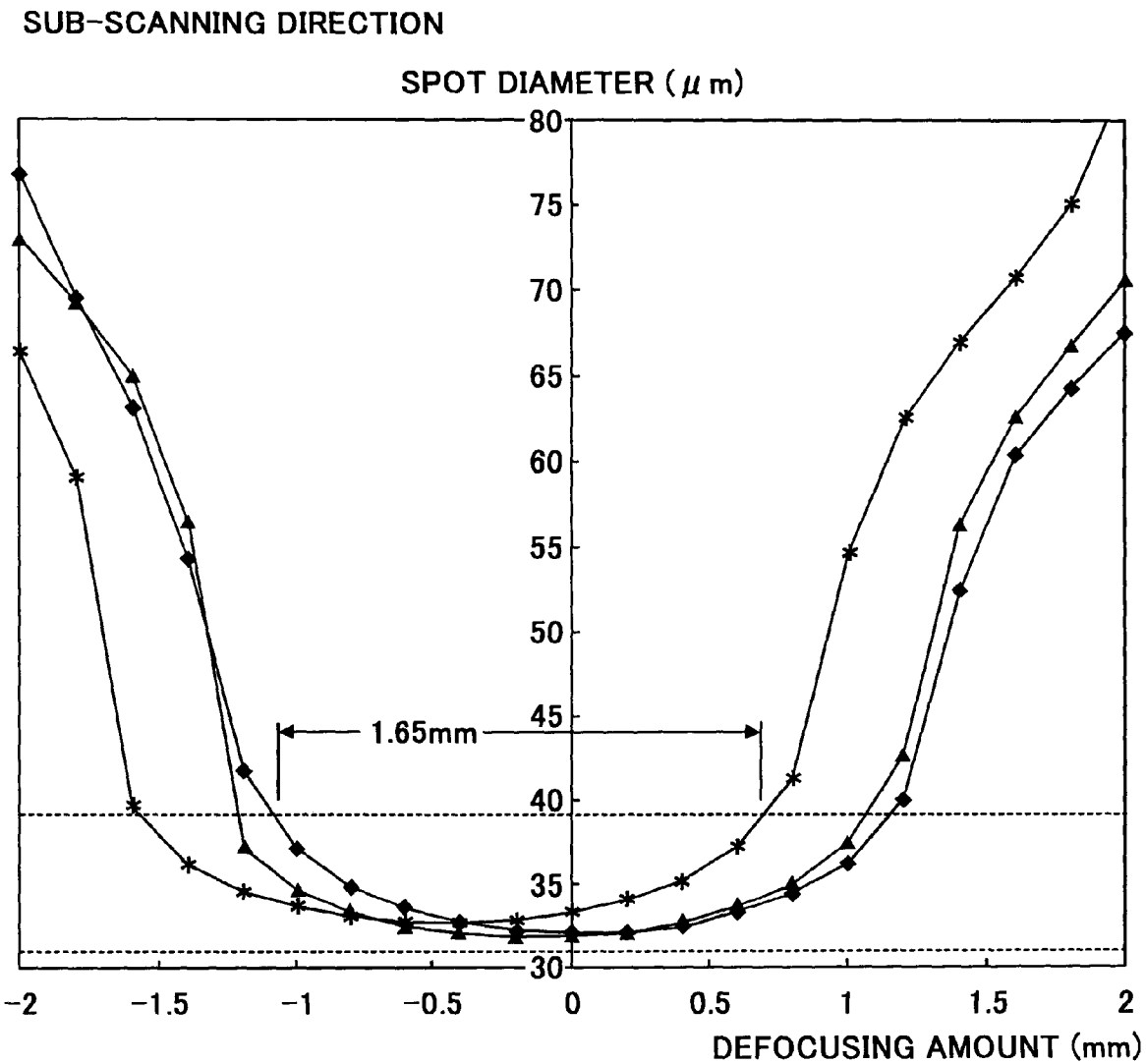
FIG. 10B is a graph illustrating a depth curve with respect to the sub-scanning direction for each image height of an optical spot diameter of an optical spot in the multi-beam optical scanning apparatus of FIG. 9.

FIG. 10A and FIG. 10B illustrate depth curves with respect to the main scanning and sub-scanning directions of an optical spot diameter of an optical spot corresponding to the light emitting source ch1 of the semiconductor laser array 1B. The depth curves are illustrated for three image height positions, the central position and two peripheral positions, respectively. As illustrated in FIG. 10A and FIG. 10B, because the effect of a variation in the diverging angles of the semiconductor laser array 1B is relatively small, a satisfactory depth is obtained with respect to both of the main scanning direction and the sub-scanning direction of the optical spot, so that a tolerance relative to positional accuracy of the scanning surface SS is relatively large. When the photoconductor 9B having the exposure energy of 4.4 $mJ/m^2$ is used, the maximum light emitting output of the semiconductor laser array 1B is 9.38 mW (<10 mW), which is sufficient as the light quantity.

Figure 11:
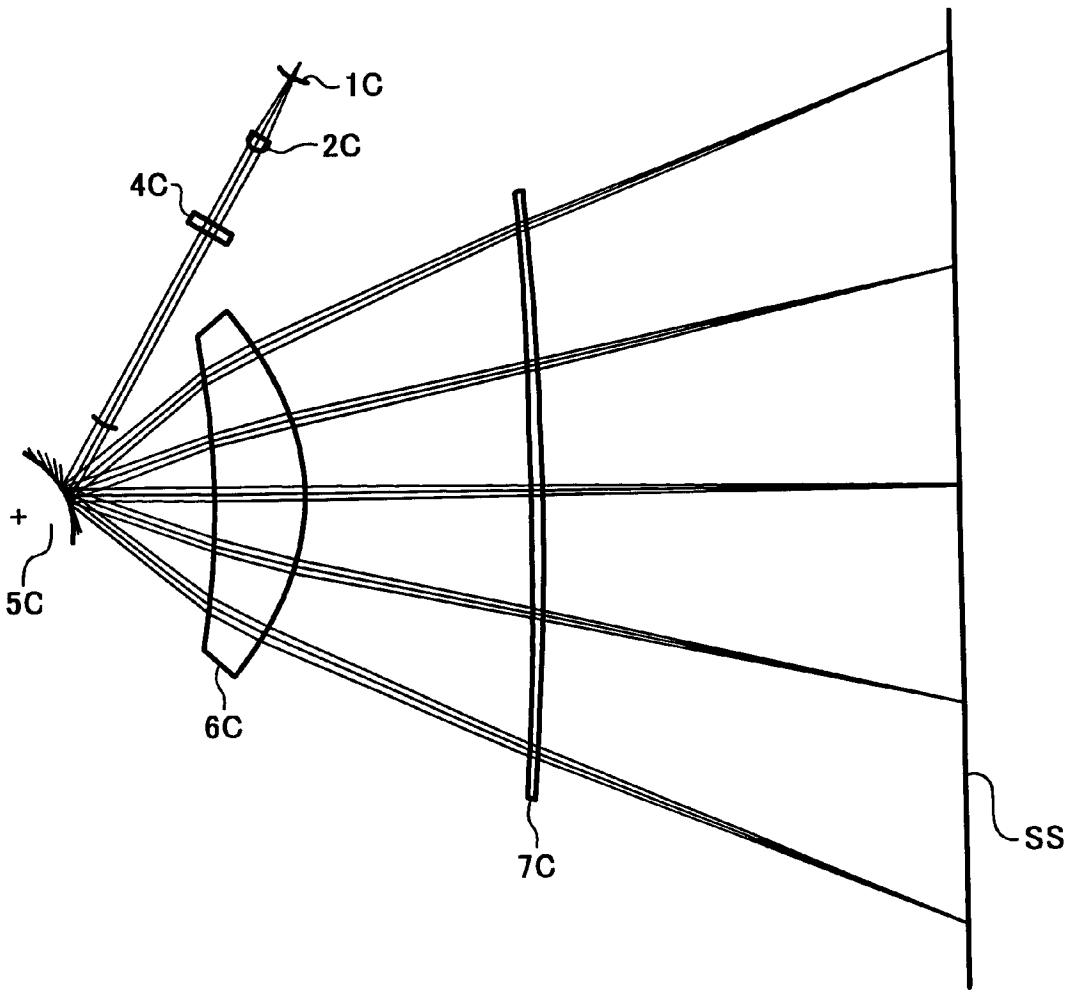
FIG. 11 is a schematic diagram of a scanning optical system of a multi-beam optical scanning apparatus according to the fourth embodiment of the present invention.

FIG. 11 schematically illustrates the construction of a scanning optical system of the multi-beam optical scanning apparatus of FIG. 1, according to the fourth embodiment of the present invention. The scanning optical system includes a coupling lens 2C, a cylindrical lens 4C, a rotating multi-faced mirror 5C, a first image forming lens 6C, and a second image forming lens 7C, which respectively correspond to the coupling lens 2, the cylindrical lens 4, the rotating multi-faced mirror 5, the first image forming lens 6, and the second image forming lens 7 in FIG. 1. A plurality of laser beams emitted from the semiconductor laser array 1C launch onto the rotating multi-faced mirror 5C via the coupling lens 2C, the aperture 3C (not illustrated in FIG. 11), and the cylindrical lens 4C, and are then reflected and deflected by the rotating multi-faced mirror 5C. The deflected beams are formed into beam spots on the scanning surface SS of the photoconductor 9C via the first image forming lens 6C and the second image forming lens 7C. As the rotating multi-faced mirror 5C rotates, the beam spots scan the scanning surface SS.

The construction of the scanning optical system of the multi-beam optical scanning apparatus according to the fourth embodiment of the present invention is hereinafter described concretely.

The semiconductor laser array 1C is constructed as follows:

the number of light emitting sources n: 4 light emitting source pitch $P_{LD}$: 80 $\mu$m wavelength: 655 nm maximum output: 10 mW slanting angle $\gamma$: 86.21° diverging angle: $\theta_{\perp}30°$, $\theta_{\parallel}9°$.

The coupling lens 2C is constructed as follows:

focal length $f_{COL}$: 30 mm (one piece of lens in one group)

coupling function: diverging function distance "d" between the coupling lens 2C and a reflective deflecting surface of the rotating multi-faced mirror 5C: 141 mm.

The cylindrical lens 4C is constructed as follows:

focal length in the sub-scanning direction: 108.87 mm.

The aperture 3C has an opening formed in an ellipse, and the dimensions of the opening are as follows:

main scanning direction $A_m$: 4.54 mm sub-scanning direction $A_s$: 1.74 mm.

The rotating multi-faced mirror 5C is constructed as follows:

the number of reflective deflecting surfaces: 6 radius of an inscribed circle: 18 mm angle formed by the optical axis of beams launching onto the rotating multi-faced mirror 5C from the side of the semiconductor laser array 1C and the optical axis of the subsequent scanning image forming optical system: 60°.

The photoconductor 9C is constructed such that the condition at the scanning surface SS is as follows:

writing density: 1200 dpi targeted optical spot diameter: 50 $\mu$m.

Data of the optical system between the rotating multi-faced mirror 5C and the scanning surface SS is indicated in Table 14.

TABLE 14

| | Surface number | $R_{mi}$ | $R_{si}(0)$ | X | Y | n |
|---|---|---|---|---|---|---|
| Reflective deflecting surface | 0 | ∞ | ∞ | 51.17 | 1.105 | |

TABLE 14-continued

| | Surface number | $R_{mi}$ | $R_{si}(0)$ | X | Y | n |
|---|---|---|---|---|---|---|
| Lens 6C | 1 | −312.6 | Rotationally symmetrical | 31.4 | 0 | 1.52718 |
| | 2 | −82.95 | rotationally symmetrical | 77.75 | 0.13 | |
| Lens 7C | 3 | −500 | −47.68 | 3.5 | 0 | 1.52718 |
| | 4 | −1000 | −23.38 | 142.6 | 0 | |

The coefficients in the main scanning direction and the sub-scanning direction of each surface are indicated in Table 15 through Table 17.

TABLE 15

| Surface number | Coefficients in the main scanning direction | |
|---|---|---|
| 1 | K | 2.667 |
| | $A_1$ | 0 |
| | $A_2$ | 0 |
| | $A_3$ | 0 |
| | $A_4$ | $1.786 \times 10^{-7}$ |
| | $A_5$ | 0 |
| | $A_6$ | $-1.081 \times 10^{-12}$ |
| | $A_7$ | 0 |
| | $A_8$ | $-3.181 \times 10^{-14}$ |
| | $A_9$ | 0 |
| | $A_{10}$ | $3.740 \times 10^{-18}$ |

TABLE 16

| Surface number | Coefficients in the main scanning direction | |
|---|---|---|
| 2 | K | $1.983 \times 10^{-2}$ |
| | $A_1$ | 0 |
| | $A_2$ | 0 |
| | $A_3$ | 0 |
| | $A_4$ | $2.503 \times 10^{-7}$ |
| | $A_5$ | 0 |
| | $A_6$ | $9.606 \times 10^{-12}$ |
| | $A_7$ | 0 |
| | $A_8$ | $4.545 \times 10^{-15}$ |
| | $A_9$ | 0 |
| | $A_{10}$ | $-3.034 \times 10^{-18}$ |

TABLE 17

| Surface number | Coefficients in the main scanning direction | | Coefficients in the sub-scanning direction | |
|---|---|---|---|---|
| 3 | K | −71.732 | $B_1$ | 0 |
| | $A_1$ | 0 | $B_2$ | $1.603 \times 10^{-3}$ |
| | $A_2$ | 0 | $B_3$ | 0 |
| | $A_3$ | 0 | $B_4$ | $-2.322 \times 10^{-7}$ |
| | $A_4$ | $4.326 \times 10^{-8}$ | $B_5$ | 0 |
| | $A_5$ | 0 | $B_6$ | $1.599 \times 10^{-11}$ |
| | $A_6$ | $-5.973 \times 10^{-13}$ | $B_7$ | 0 |
| | $A_7$ | 0 | $B_8$ | $-5.610 \times 10^{-16}$ |
| | $A_8$ | $-1.282 \times 10^{-16}$ | $B_9$ | 0 |
| | $A_9$ | 0 | $B_{10}$ | $2.176 \times 10^{-20}$ |
| | $A_{10}$ | $5.730 \times 10^{-21}$ | $B_{11}$ | 0 |
| | $A_{11}$ | 0 | $B_{12}$ | $-1.250 \times 10^{-24}$ |

The numerical values of parameters in the scanning optical system of the above-described third embodiment are as follows:

$L_m$: 26.7 mm $L_s$: 8.04 mm

β: 1.108

$D_m$: 20.38 mm

δ: 0.94 mm

W: 300 mm

Δ: 0.63 mm

θ: 1.964°

α: 4.075.

From the above, the above-described conditional formula (2) is satisfied as follows:

$$L_s/L_m=8.04/26.7=0.301,\ A_s/A_m=1.74/4.54=0.383.$$

Also, the conditional formula (3) is satisfied as follows:

$$\{\beta\times P_{LD}\times\sin\gamma\times(n-1)\times((d-f_{COL})/f_{COL})\}/\omega_s=$$
$$\{1.108\times(80\times10^{-3})\times\sin86.21^{\circ}\times(4-1)\times((141-30)/30)\}/50\times10^{-3}=$$
$$19.68.$$

Also, the conditional formula (4) is satisfied as follows:

$$(D_m\times\omega_m)/(\delta\times W)=(20.38\times(50\times10^{-3}))/(0.94\times300)$$
$$=3.6\times10^{-2}.$$

Further, because the conditional formula (6) is satisfied as follows, a method of obtaining a synchronization signal from one of the plurality of optical beams can be adopted:

$$\Delta\times(\cos(\theta-1)-\cos\theta)\times dpi/25.4=0.63\times(\cos(1.964^{\circ}-1^{\circ})-\cos 1.964^{\circ})\times1200/25.4=0.0133.$$

Furthermore, because $\Delta\times\cos\theta=0.63\times\cos 1.964^{\circ}=0.63>3\times\omega_m=3\times50\times10^{-3}0.15$, a method of obtaining a synchronization signal for each of the plurality of beams can be adopted.

Figure 12A:
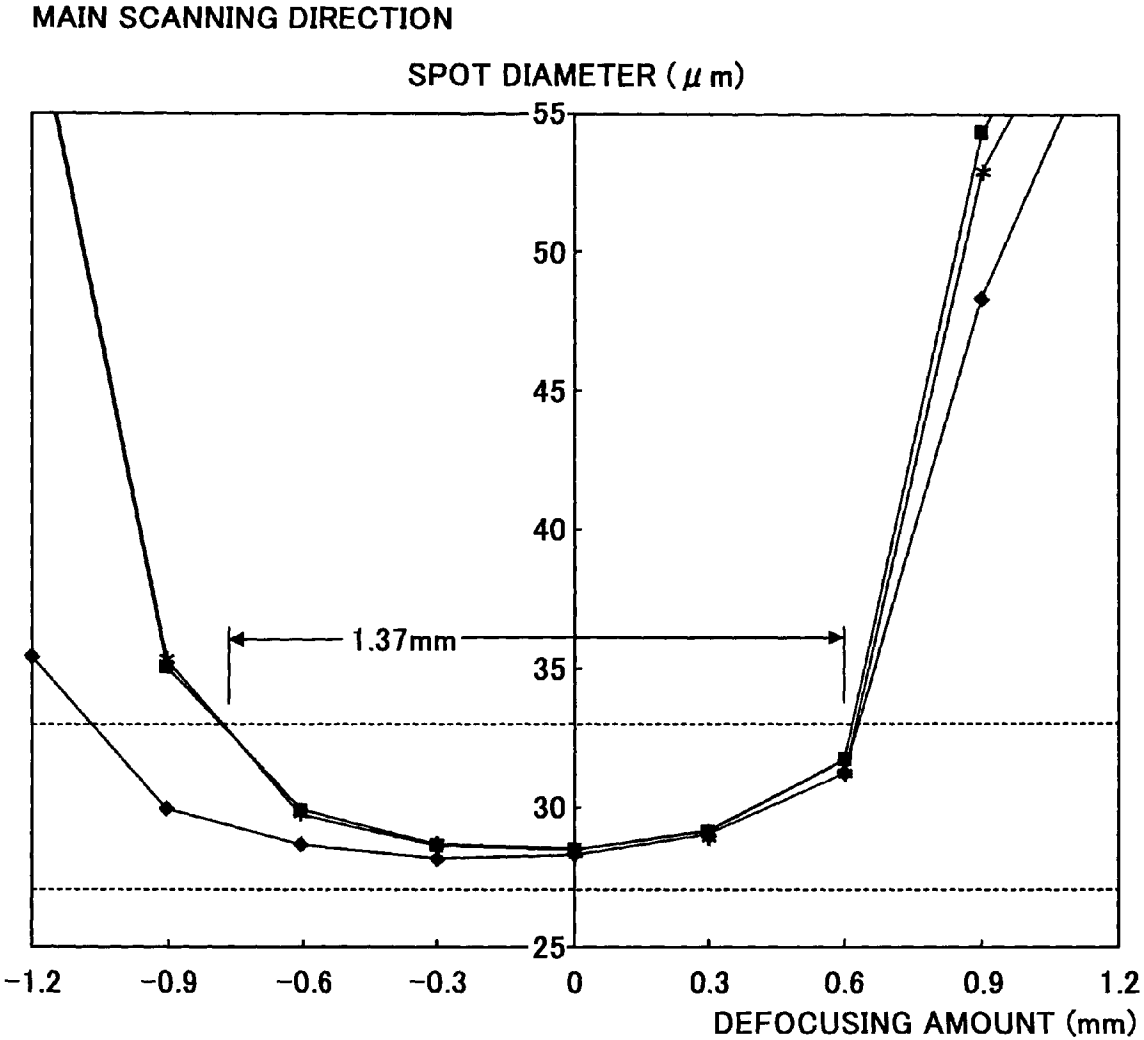
FIG. 12A is a graph illustrating a depth curve with respect to the main scanning direction for each image height of an optical spot diameter of an optical spot in the multi-beam optical scanning apparatus of FIG. 11.
Figure 12B:
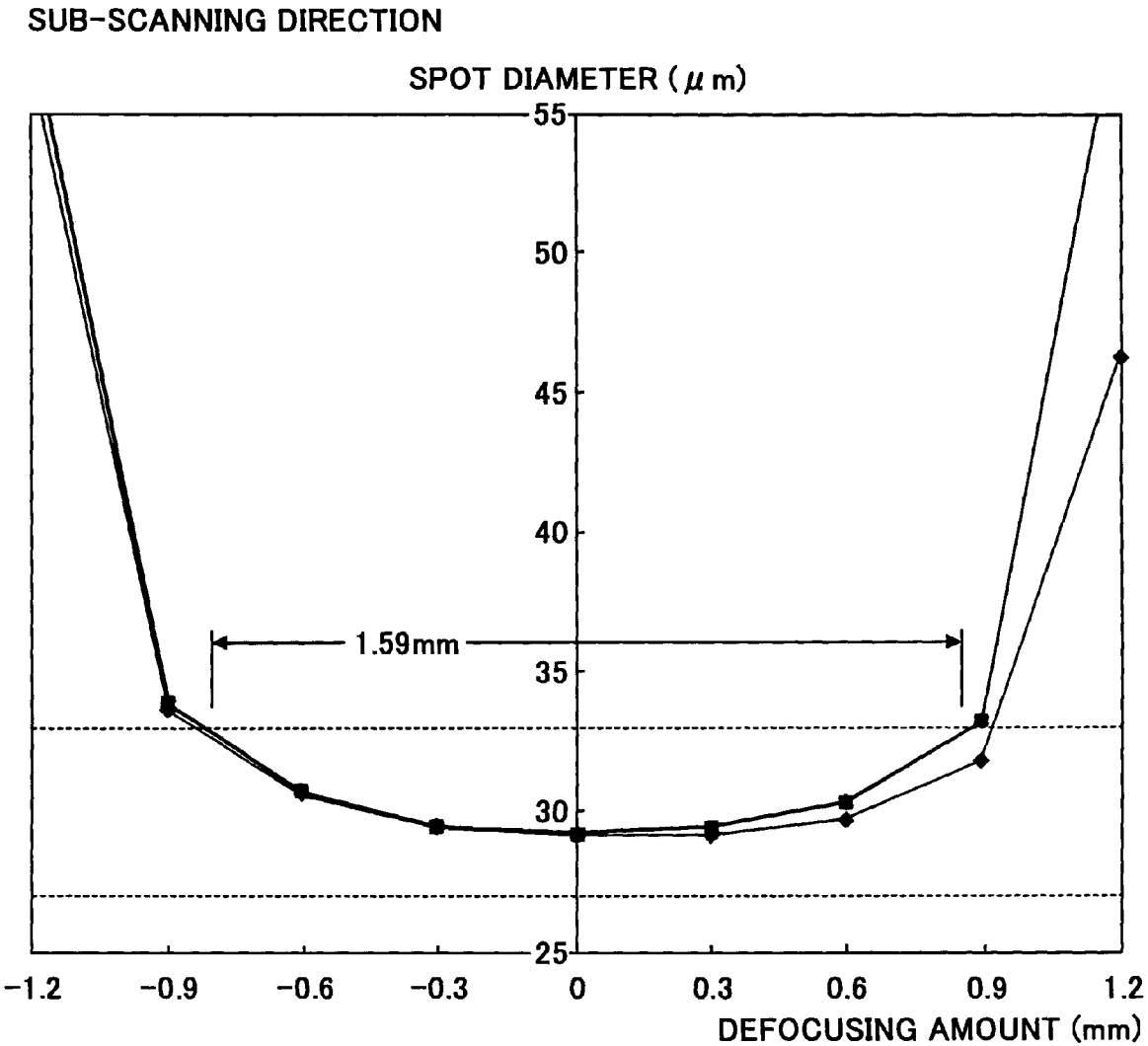
FIG. 12B is a graph illustrating a depth curve with respect to the sub-scanning direction for each image height of an optical spot diameter of an optical spot in the multi-beam optical scanning apparatus of FIG. 11.

FIG. 12A and FIG. 12B illustrate depth curves with respect to the main scanning and sub-scanning directions of an optical spot diameter of an optical spot corresponding to the light emitting source ch1 of the semiconductor laser array 1C. The depth curves are illustrated for three image height positions, the central position and two peripheral positions, respectively. As illustrated in FIG. 12A and FIG. 12B, because the effect of a variation in the diverging angles of the semiconductor laser array 1C is relatively small, a satisfactory depth is obtained with respect to both of the main scanning direction and the sub-scanning direction of the optical spot, so that a tolerance relative to a positional accuracy of the scanning surface SS is relatively large. When the photoconductor 9C having the exposure energy of 4 $mJ/m^2$ is used, the maximum light emitting output of the semiconductor laser array 1C is 9.4 mW (<10 mW), which is sufficient as the light quantity.

Figure 13:
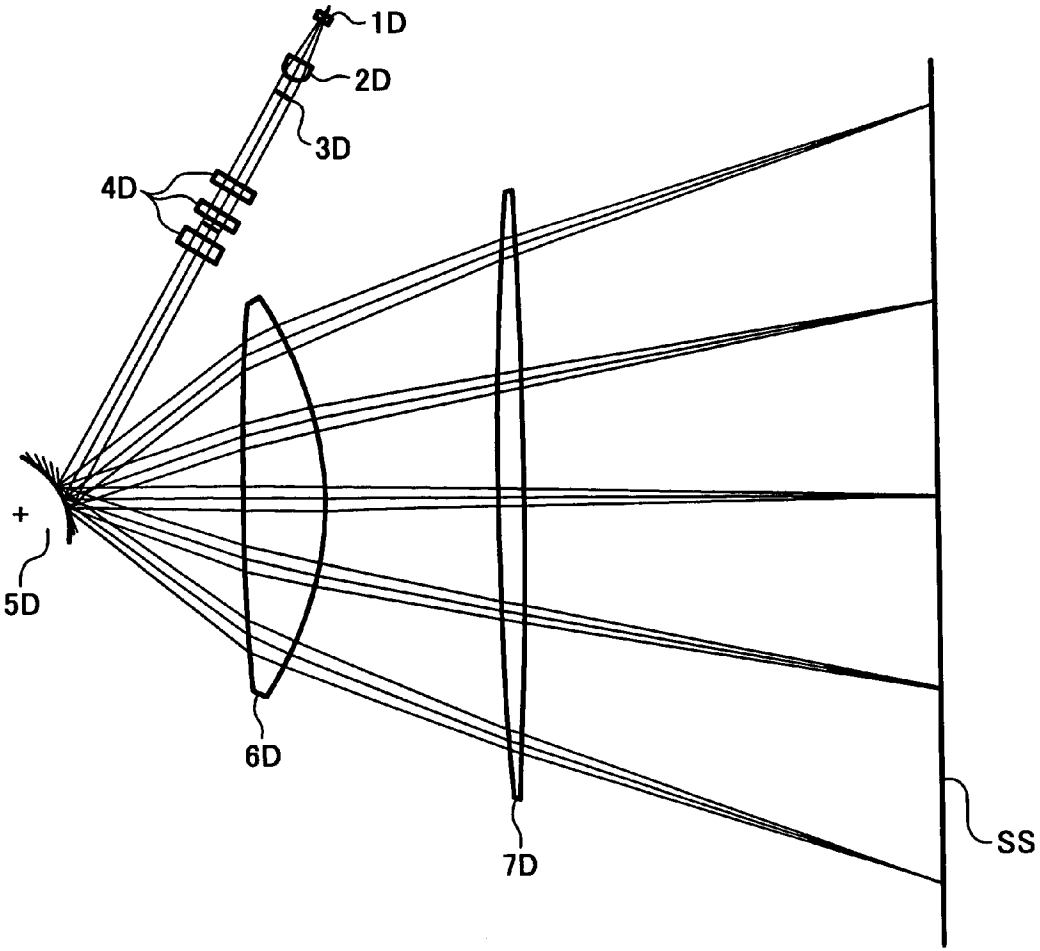
FIG. 13 is a schematic diagram of a scanning optical system of a multi-beam optical scanning apparatus according to the fifth embodiment of the present invention.

FIG. 13 schematically illustrates the construction of a scanning optical system of the multi-beam optical scanning apparatus of FIG. 1, according to the fifth embodiment of the present invention. The scanning optical system includes a coupling lens 2D, an aperture 3D, a cylindrical lens 4D, a rotating multi-faced mirror 5D, a first image forming lens 6D, and a second image forming lens 7D, which respectively correspond to the coupling lens 2, the aperture 3, the cylindrical lens 4, the rotating multi-faced mirror 5, the first image forming lens 6, and the second image forming lens 7 in FIG. 1. A plurality of laser beams emitted from the semiconductor laser array 1D launch onto the rotating multi-faced mirror 5D via the coupling lens 2D, the aperture 3D, and the cylindrical lens 4D, and are then reflected and deflected by the rotating multi-faced mirror 5D. The deflected beams are formed into beam spots on the scanning surface SS of the photoconductor 9D via the first image forming lens 6D and the second image forming lens 7D. As the rotating multi-faced mirror 5D rotates, the beam spots scan the scanning surface SS.

The construction of the scanning optical system of the multi-beam optical scanning apparatus according to the fourth embodiment of the present invention is hereinafter described concretely.

The semiconductor laser array 1D is constructed as follows:

the number of light emitting sources n: 4 light emitting source pitch $P_{LD}$: 14 μm wavelength: 780 nm maximum output: 10 mW slanting angle γ: 12.39° diverging angle: $\theta_{\perp}30°$, $\theta_{\parallel}9°$.

The coupling lens 2D is constructed as follows:

focal length $f_{COL}$: 27 mm (one piece of lens in one group)

coupling function: collimating function distance "d" between the coupling lens 2D and a reflective deflecting surface of the rotating multi-faced mirror 5D: 192.55 mm.

The cylindrical lens 4D is constructed as follows:

focal length in the sub-scanning direction: 46.06 mm (three pieces of lenses in three groups).

The aperture 3D has an opening formed in an ellipse, and the dimensions of the opening are as follows:

main scanning direction $A_m$: 8.2 mm sub-scanning direction $A_s$: 1.6 mm.

The rotating multi-faced mirror 5D is constructed as follows:

the number of reflective deflecting surfaces: 5 radius of an inscribed circle: 18 mm angle formed by the optical axis of beams launching onto the rotating multi-faced mirror 5D from the side of the semiconductor laser array 1D and the optical axis of the subsequent scanning image forming optical system: 60°.

The photoconductor 9D is constructed such that the condition at the scanning surface SS is as follows:

writing density: 1200 dpi targeted optical spot diameter: 30 μm.

Data of the optical system between the rotating multi-faced mirror 5D and the scanning surface SS is indicated in Table 18.

TABLE 18

| | Surface number | $R_{mi}$ | $R_{si}(0)$ | X | Y | N |
|---|---|---|---|---|---|---|
| Reflective deflecting surface | 0 | ∞ | ∞ | 71.6 | 0.274 | |
| Lens 6D | 1 | −1030.2 | −89.52 | 30 | 0 | 1.52397 |
| | 2 | −109.08 | −110.88 | 66.32 | 0.13 | |
| Lens 7D | 3 | 1493.65 | −70.07 | 8.5 | 0 | 1.52397 |
| | 4 | 1748.58 | −28.03 | 159.34 | 0 | |

The coefficients in the main scanning direction and the sub-scanning direction of each surface are indicated in Table 19 through Table 22, and the coefficients in the sub-scanning direction of the emerging surface (the fourth surface) of the second image forming lens 7D are indicated in Table 23.

TABLE 19

| Surface number | Coefficients in the main scanning direction | | Coefficients in the sub-scanning direction | |
|---|---|---|---|---|
| 1 | $R_m$ | −1030.233 | $R_s$ | −89.519 |
| | K | $-4.042 \times 10^{+2}$ | $B_1$ | $-9.318 \times 10^{-6}$ |
| | $A_1$ | 0 | $B_2$ | $3.270 \times 10^{-6}$ |
| | $A_2$ | 0 | $B_3$ | $4.132 \times 10^{-9}$ |
| | $A_3$ | 0 | $B_4$ | $-4.208 \times 10^{-10}$ |
| | $A_4$ | $6.005 \times 10^{-8}$ | $B_5$ | $-1.170 \times 10^{-12}$ |
| | $A_5$ | 0 | $B_6$ | $4.371 \times 10^{-14}$ |
| | $A_6$ | $-7.538 \times 10^{-13}$ | $B_7$ | $2.348 \times 10^{-16}$ |
| | $A_7$ | 0 | $B_8$ | $-6.213 \times 10^{-18}$ |
| | $A_8$ | $-4.037 \times 10^{-16}$ | $B_9$ | $-3.968 \times 10^{-20}$ |
| | $A_9$ | 0 | $B_{10}$ | $-3.874 \times 10^{-21}$ |
| | $A_{10}$ | $4.592 \times 10^{-20}$ | $B_{11}$ | $3.817 \times 10^{-24}$ |
| | $A_{11}$ | 0 | $B_{12}$ | $4.536 \times 10^{-25}$ |
| | $A_{12}$ | $-2.397 \times 10^{-24}$ | $B_{13}$ | 0 |

TABLE 20

| Surface number | Coefficients in the main scanning direction | | Coefficients in the sub-scanning direction | |
|---|---|---|---|---|
| 2 | $R_m$ | −109.082 | $R_s$ | −110.881 |
| | K | $-5.428 \times 10^{-1}$ | $B_1$ | 0 |
| | $A_1$ | 0 | $B_2$ | $-3.653 \times 10^{-7}$ |
| | $A_2$ | 0 | $B_3$ | 0 |
| | $A_3$ | 0 | $B_4$ | $2.337 \times 10^{-11}$ |
| | $A_4$ | $9.539 \times 10^{-8}$ | $B_5$ | 0 |
| | $A_5$ | 0 | $B_6$ | $8.426 \times 10^{-14}$ |
| | $A_6$ | $4.882 \times 10^{-13}$ | $B_7$ | 0 |
| | $A_7$ | 0 | $B_8$ | $-1.026 \times 10^{-17}$ |
| | $A_8$ | $-1.199 \times 10^{-16}$ | $B_9$ | 0 |
| | $A_9$ | 0 | $B_{10}$ | $-2.202 \times 10^{-21}$ |
| | $A_{10}$ | $5.030 \times 10^{-20}$ | $B_{11}$ | 0 |
| | $A_{11}$ | 0 | $B_{12}$ | $1.225 \times 10^{-26}$ |
| | $A_{12}$ | $-5.654 \times 10^{-24}$ | $B_{13}$ | 0 |

TABLE 21

| Surface number | Coefficients in the main scanning direction | | Coefficients in the sub-scanning direction | |
|---|---|---|---|---|
| 3 | $R_m$ | −1493.655 | $R_s$ | −70.072 |
| | K | 54.794 | $B_1$ | 0 |
| | $A_1$ | 0 | $B_2$ | $-8.702 \times 10^{-8}$ |
| | $A_2$ | 0 | $B_3$ | 0 |
| | $A_3$ | 0 | $B_4$ | $2.829 \times 10^{-11}$ |
| | $A_4$ | $-7.607 \times 10^{-9}$ | $B_5$ | 0 |
| | $A_5$ | 0 | $B_6$ | $-1.930 \times 10^{-15}$ |
| | $A_6$ | $-6.311 \times 10^{-13}$ | $B_7$ | 0 |
| | $A_7$ | 0 | $B_8$ | $2.767 \times 10^{-20}$ |
| | $A_8$ | $6.134 \times 10^{-17}$ | $B_9$ | 0 |
| | $A_9$ | 0 | $B_{10}$ | $2.177 \times 10^{-24}$ |
| | $A_{10}$ | $-1.482 \times 10^{-21}$ | $B_{11}$ | 0 |
| | $A_{11}$ | 0 | $B_{12}$ | $-6.108 \times 10^{-29}$ |
| | $A_{12}$ | $2.429 \times 10^{-26}$ | $B_{13}$ | 0 |
| | $A_{13}$ | 0 | $B_{14}$ | 0 |
| | $A_{14}$ | $-1.689 \times 10^{-30}$ | $B_{15}$ | 0 |

TABLE 22

| Surface number | Coefficients in the main scanning direction | | Coefficients in the sub-scanning direction | |
|---|---|---|---|---|
| 4 | $R_m$ | 1748.584 | $R_s$ | −28.035 |
| | K | $-5.489 \times 10^{+2}$ | $B_1$ | $-1.440 \times 10^{-6}$ |
| | $A_1$ | 0 | $B_2$ | $4.696 \times 10^{-7}$ |
| | $A_2$ | 0 | $B_3$ | $1.854 \times 10^{-11}$ |
| | $A_3$ | 0 | $B_4$ | $-4.153 \times 10^{-11}$ |
| | $A_4$ | $-4.978 \times 10^{-8}$ | $B_5$ | $-8.494 \times 10^{-16}$ |
| | $A_5$ | 0 | $B_6$ | $2.193 \times 10^{-15}$ |

TABLE 22-continued

| Surface number | Coefficients in the main scanning direction | | Coefficients in the sub-scanning direction | |
|---|---|---|---|---|
| | $A_6$ | $2.325 \times 10^{-12}$ | $B_7$ | $9.004 \times 10^{-19}$ |
| | $A_7$ | 0 | $B_8$ | $-9.272 \times 10^{-21}$ |
| | $A_8$ | $-7.619 \times 10^{-17}$ | $B_9$ | $-1.328 \times 10^{-22}$ |
| | $A_9$ | 0 | $B_{10}$ | $-1.410 \times 10^{-24}$ |
| | $A_{10}$ | $3.323 \times 10^{-21}$ | $B_{11}$ | $5.520 \times 10^{-27}$ |
| | $A_{11}$ | 0 | $B_{12}$ | $4.513 \times 10^{-30}$ |
| | $A_{12}$ | $-3.571 \times 10^{-26}$ | $B_{13}$ | 0 |
| | $A_{13}$ | 0 | $B_{14}$ | 0 |
| | $A_{14}$ | $-2.199 \times 10^{-30}$ | $B_{15}$ | 0 |

TABLE 23

| | | | | | | |
|---|---|---|---|---|---|---|
| 4 | $C_0$ | −1.000 | $I_0$ | $-1.321 \times 10^{-7}$ | $K_0$ | $9.397 \times 10^{-9}$ |
| | $C_1$ | 0 | $I_1$ | 0 | $K_1$ | 0 |
| | $C_2$ | 0 | $I_2$ | $-1.088 \times 10^{-11}$ | $K_2$ | $1.149 \times 10^{-12}$ |
| | $C_3$ | 0 | $I_3$ | 0 | $K_3$ | 0 |
| | $C_4$ | 0 | $I_4$ | $-9.023 \times 10^{-16}$ | $K_4$ | $8.064 \times 10^{-17}$ |
| | $C_5$ | 0 | $I_5$ | 0 | $K_5$ | 0 |
| | $C_6$ | 0 | $I_6$ | $-7.344 \times 10^{-20}$ | $K_6$ | $-1.474 \times 10^{-20}$ |

The numerical values of parameters in the scanning optical system of the above-described fifth embodiment are as follows:

$L_m$: 7.38 mm
$L_s$: 20.15 mm
β: 0.913
$D_m$: 25.74 mm
δ: 0.05 mm
W: 300 mm
Δ: 0.09 mm
θ: 42.725°
α: 1.547.

From the above, the above-described conditional formula (3) is satisfied as follows:

$$\{\beta \times P_{LD} \times \sin\gamma \times (n-1) \times ((d - f_{COL})/f_{COL})\}/\omega_s = \{0.913 \times (14 \times 10^{-3}) \times \sin 12.39^\circ \times (4-1) \times ((192.55 - 27)/27)\}/30 \times 10^{-3} = 1.68.$$

Also, the conditional formula (4) is satisfied as follows:

$$(D_m \times \omega_m)/(\delta \times W) = (25.74 \times (30 \times 10^{-3}))/(0.05 \times 300) = 5.1 \times 10^{-2}.$$

The conditional formula (5) is also satisfied as follows:

$$P_{LD} \times (n-1) \times \alpha \times (\cos(\gamma - 1) - \cos\gamma) \times \mathrm{dpi}/25.4 = (14 \times 10^{-3}) \times (4-1) \times 1.547 \times (\cos(12.39^\circ - 1^\circ) - \cos 12.39^\circ) \times 1200/25.4 = 0.011.$$

Further, because the conditional formula (6) is satisfied as follows, a method of obtaining a synchronization signal from one of the plurality of optical beams can be adopted:

$$\Delta \times (\cos(\theta - 1) - \cos\theta) \times dpi/25.4 = 0.09 \times (\cos(42.725^\circ - 1^\circ) - \cos 42.725^\circ) \times 1200/25.4 = 0.0499.$$

Figure 14A:
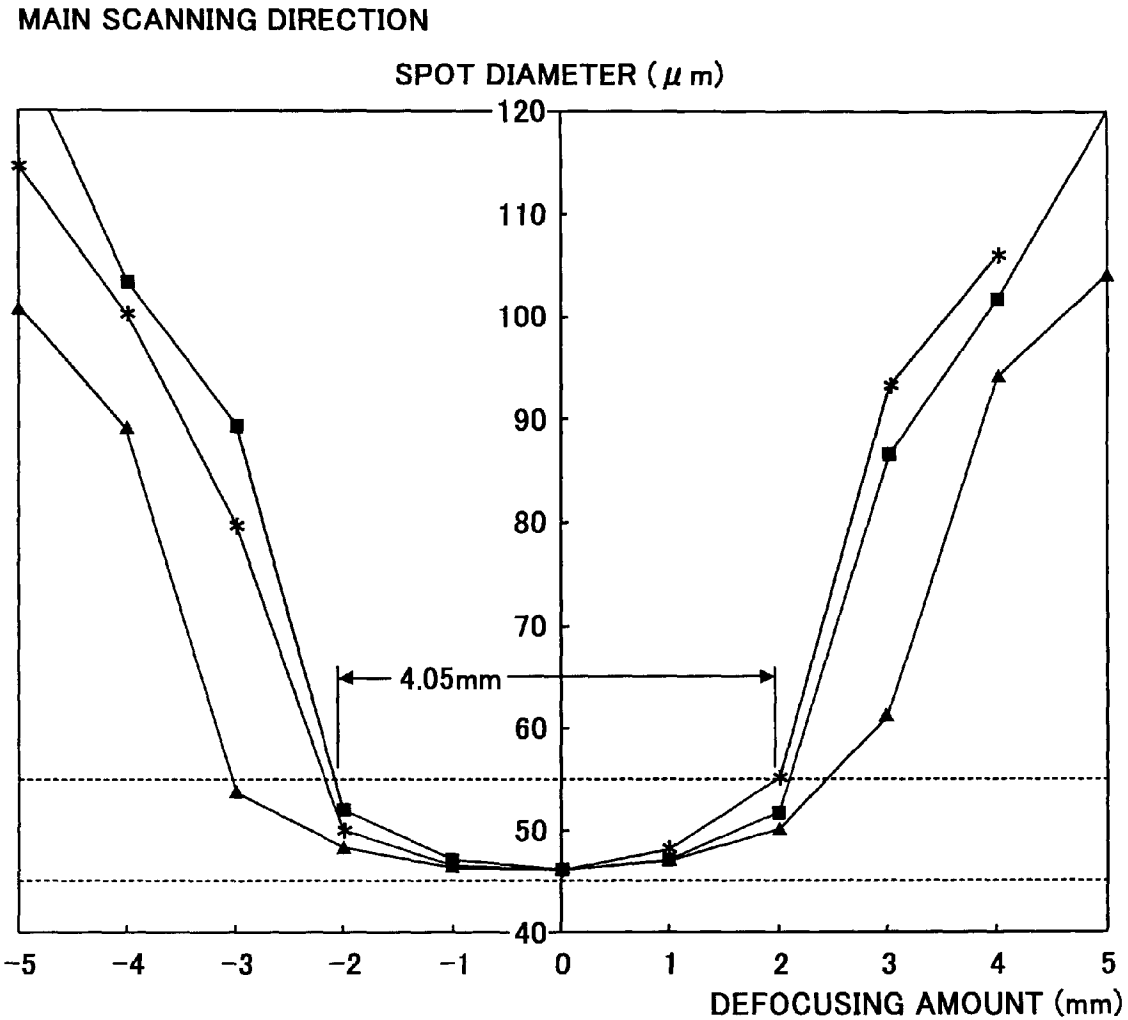
FIG. 14A is a graph illustrating a depth curve with respect to the main scanning direction for each image height of an optical spot diameter of an optical spot in the multi-beam optical scanning apparatus of FIG. 13.
Figure 14B:
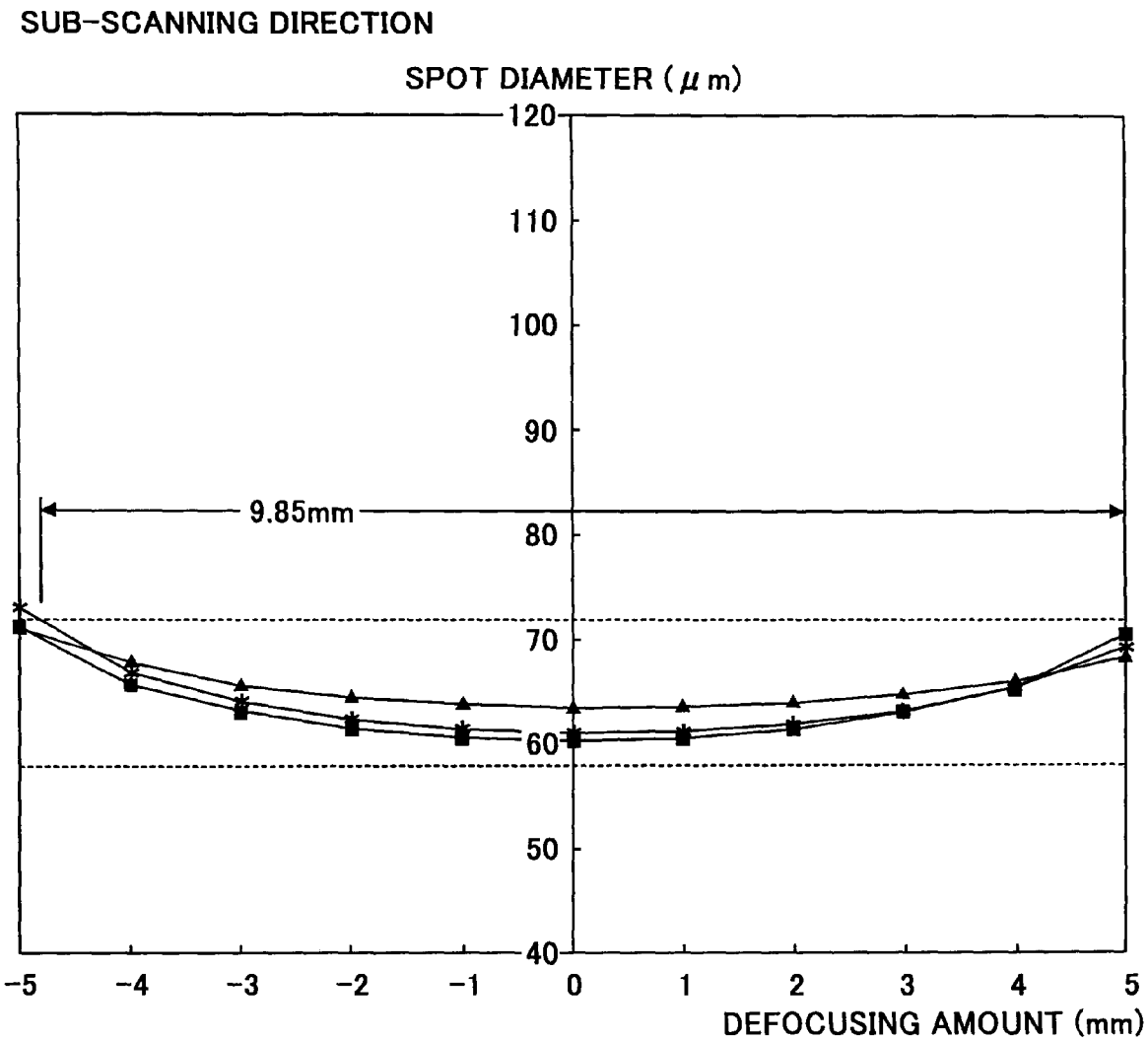
FIG. 14B is a graph illustrating a depth curve with respect to the sub-scanning direction for each image height of an optical spot diameter of an optical spot in the multi-beam optical scanning apparatus of FIG. 13.

FIG. 14A and FIG. 14B illustrate depth curves with respect to the main scanning and sub-scanning directions of an optical spot diameter of an optical spot corresponding to the light emitting source ch1 of the semiconductor laser array 1D. The depth curves are illustrated for three image height positions, the central position and two peripheral positions, respectively. As illustrated in FIG. 14A and FIG. 14B, because the effect of a variation in the diverging angles of the semiconductor laser array 1D is relatively small, a satisfactory depth is obtained with respect to both of the main scanning direction and the sub-scanning direction of the optical spot, so that a tolerance relative to a positional accuracy of the scanning surface SS is relatively large. When the photoconductor 9D having the exposure energy of 4 $mJ/m^2$ is used, the maximum light emitting output of the semiconductor laser array 1D is 9.3 mW (<10 mW), which is sufficient as the light quantity.

Figure 15:
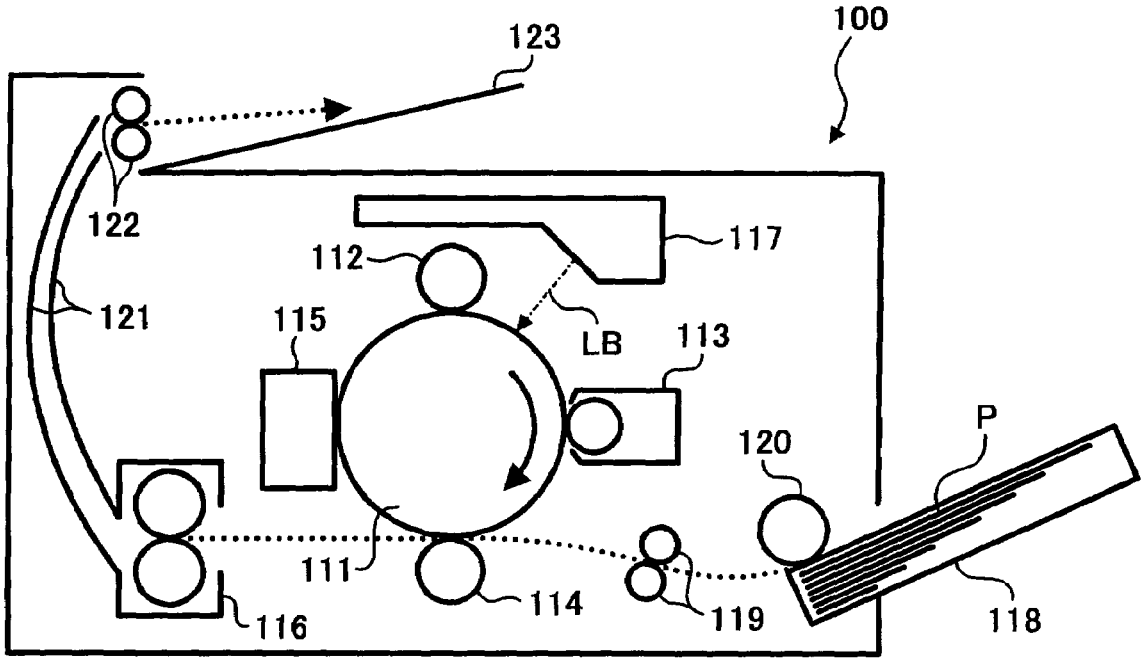
FIG. 15 is a schematic cross section of an image forming apparatus according to another preferred embodiment of the present invention.

Turning now to FIG. 15, which is a schematic cross section of an image forming apparatus according to a preferred embodiment of the present invention. The image forming apparatus of FIG. 15 is configured as a laser printer. A laser printer 100 of FIG. 15 includes an image bearing member 111, a charging roller 112, a development device 113, a transfer roller 114, a cleaning device 115, a fixing device 116, an optical scanning device 117, a sheet feeding cassette 118, a registration roller pair 119, a sheet feeding roller 120, a sheet conveying path 121, a sheet discharging roller pair 122, and a sheet receiving tray 123.

The image bearing member 111 includes a photoconductor formed in a cylindrical-like shape. The charging roller 112, the development device 113, the transfer roller 114, and the cleaning device 115 are arranged around the image bearing member 111. A corona charging device may be used in place of the charging roller 112 as a charging device. The image bearing member 11 is exposed by optical writing with a laser beam LB of the optical scanning device 117 between the charging roller 112 and the development device 113. For the optical scanning device 117, any of the multi-beam optical scanning apparatuses described above with reference to and illustrated in FIG. 1 and FIG. 5, FIG. 7, FIG. 9, FIG. 11, and FIG. 13, respectively, may be used.

The image bearing member 111 rotates in the clock-wise direction in the figure at a constant velocity, the charging roller 112 uniformly charges the surface of the image bearing member 111, and the charged surface of the image veering member 111 is exposed by optical writing with the laser beam LB of the optical scanning device 117, and thereby an electrostatic latent image is formed on the image bearing member 111. The electrostatic latent image is a so-called negative image in which an image part is exposed, and is developed by the development device 113, so that a toner image is formed on the image bearing member 111.

The sheet cassette 118 accommodates transfer sheets P, and is detachably attached to the main body of the laser printer 100 as an image forming apparatus. The uppermost sheet P in the sheet cassette 118 is fed by the sheet feeding roller 120, and the fed sheet P is nipped by the registration roller pair 119 at the leading edge thereof. The registration roller pair 119 feeds out the sheet P to be conveyed to a transfer position near the transfer roller 114 in such timing that the toner image on the image bearing member 111 reaches the transfer position. The transfer sheet P is superimposed with the toner image on the image bearing member 111 at the transfer position, and the toner image is electrostatically transferred onto the transfer sheet P by a function of the transfer roller 114. The transfer sheet P onto which the toner image has been transferred is conveyed to the fixing device 1116, where the toner image is fixed onto the transfer sheet P. The transfer sheet P is then conveyed through the sheet conveying path 121, and is discharged onto the sheet receiving tray 123 by the sheet discharging roller pair 122. Further, the surface of the image bearing member 111 after the toner image has been transferred is cleaned by the cleaning device 111 so that residual toner and paper dust are removed.

As described above, the image forming apparatus 100 uses for the optical scanning device 117, the optical scanning device of the present invention illustrated in FIG. 5, FIG. 7, FIG. 9, FIG. 11 or FIG. 13, so that satisfactory images are formed.

Numerous additional modifications and variations of the present invention are possible in light of the above teachings. It is therefore to be understood that within the scope of the appended claims, the present invention may be practiced otherwise than as specifically described herein.

The invention claimed is:

1. A multi-beam optical scanning apparatus comprising:

a semiconductor laser array slanted relative to a sub-scanning direction and emitting a plurality of optical beams;

a coupling lens converting a shape of each optical beam emitted from the semiconductor laser array; and an aperture with an opening having a size of $A_m \times A_s$, arranged after the coupling lens in a direction in which the optical beam progesses, wherein $A_m$ is a dimension of the opening in a main scanning direction and $A_s$ is a dimension of the opening in the sub-scanning direction;

wherein when a length in the main scanning direction of a contour line defined by $1/e^2$ strength of a maximum strength of an optical beam at a position of the aperture is $L_m$; and a length in the sub-scanning direction of the contour line defined by $1/e^2$ strength of the maximum strength of the optical beam at the position of the aperture is $L_s$, following conditional expressions are satisfied:

$$A_m < L_m; \text{ and}$$

$$L_s/L_m \times 0.3 < A_s/A_m < L_m \times 1.7;$$

wherein the multi-beam optical scanning apparatus further comprises:

an optical deflector deflecting the optical beam in the main scanning direction; and an image forming optical system arranged after the optical deflector in a direction in which the optical beam progresses and condensing the optical beam to obtain an optical spot having a size of $\omega_m \times \omega_s$ on a scanning surface, wherein $\omega_m$ is a dimension of the optical spot in the main scanning direction and $\omega_s$ is a dimension of the optical spot in the sub-scanning direction, wherein when a size of an effective area of a surface of the optical deflector is $D_m \times D_s$, $D_m$ being a dimension of the effective area in the main scanning direction and $D_s$ being a dimension of the effective area in the sub-scanning direction; a distance in the main scanning direction between optical beams of the plurality of optical beams reaching the optical deflector, that are separated at most in the main scanning direction, is $\delta$; and an effective writing width on the scanning surface is W, a following conditional expression is satisfied:

$$(D_m \times \omega_m)/(\delta \times W) > 5 \times 10^{-4}.$$

2. The multi-beam optical scanning apparatus according to claim 1, further comprising:

a synchronization detect device arranged at a position equivalent to a scanning surface and configured to obtain a synchronization signal based upon one of the plurality of optical beams, wherein when a distance between adjacent optical beams on the scanning surface is Δ; and an angle relative to the main scanning direction of the adjacent optical beams on the scanning surface is θ, a following conditional expression is satisfied:

$$\Delta\times(\cos(\theta-1)-\cos\theta)\times dpi/25.4<1/8.$$

3. The multi-beam optical scanning apparatus according to claim 2, wherein the synchronization detect device is arranged at a side of a scanning starting position, and wherein the synchronization signal is obtained based upon an optical beam of the plurality of optical beams, that is incident onto the synchronization detect device last among the plurality of optical beams.

4. The multi-beam optical scanning apparatus according to claim 1, further comprising:

a synchronization detect device arranged at a position equivalent to the scanning surface and configured to obtain a synchronization signal for each of the plurality of optical beams, wherein when a distance between adjacent optical beams on the scanning surface is Δ; and an angle relative to the main scanning direction of the adjacent optical beams on the scanning surface is θ, a following conditional expression is satisfied:

$$\Delta\times\cos\theta>3\times\omega_m.$$

5. The multi-beam optical scanning apparatus according to claim 1, wherein when an image forming lateral magnification of the image forming optical system in the sub-scanning direction is β, β satisfies a following conditional expression:

$$0.5<\beta<1.5.$$

6. The multi-beam optical scanning apparatus according to claim 1, wherein when an interval of light emitting points of the semiconductor laser array is $P_{LD}$, $P_{LD}$ is equal to or smaller than 100 μm.

7. The multi-beam optical scanning apparatus according to claim 1, wherein the opening of the aperture is formed in an ellipse.

8. A multi-beam optical scanning apparatus comprising:

a semiconductor laser array slanted relative to a sub-scanning direction and emitting a plurality of optical beams;

a coupling lens converting a shape of each optical beam emitted from the semiconductor laser array;

an optical deflector deflecting the optical beam in a main scanning direction; and an image forming optical system arranged after the optical deflector in a direction in which the optical beam progresses and condensing the optical beam to obtain an optical spot having a size of $\omega_m\times\omega_s$ on a scanning surface, wherein $\omega_m$ is a dimension of the optical spot in the main scanning direction and $\omega_s$ is a dimension of the optical spot in the sub-scanning direction, wherein when an image forming lateral magnification of the image forming optical system in the sub-scanning direction is β; an interval of light emitting points of the semiconductor laser array is $P_{LD}$; a rotation angle of the semiconductor laser array in the sub-scanning direction is γ, a number of the light emitting points of the semiconductor laser array is n; a distance from the coupling lens to the optical deflector is d; and a focal length of the coupling lens is $f_{COL}$, a following conditional expression is satisfied:

$$0<\{\beta\times P_{LD}\times\sin\gamma\times(n-1)\times(d-f_{COL})/f_{COL}\}/\omega_s<100;$$

wherein when a size of an effective area of a surface of the optical deflector is $D_m\times D_s$, $D_m$ being a dimension of the effective area in the main scanning direction and $D_s$ being a dimension of the effective area in the sub-scanning direction; a distance in the main scanning direction between optical beams of the plurality of optical beams reaching the optical deflector, that are separated at most in the main scanning direction, is δ; and an effective writing width on the scanning surface is W, a following conditional expression is satisfied:

$$(D_m\times\omega_m)/(\delta\times W)>5\times10^{-4}.$$

9. The multi-beam optical scanning apparatus according to claim 8, further comprising:

a synchronization detect device arranged at a position equivalent to the scanning surface and configured to obtain a synchronization signal based upon one of the plurality of optical beams, wherein when a distance between adjacent optical beams on the scanning surface is Δ; and an angle relative to the main scanning direction of the adjacent optical beams on the scanning surface is θ, a following conditional expression is satisfied:

$$\Delta\times(\cos(\theta-1)-\cos\theta)\times dpi/25.4<1/8.$$

10. The multi-beam optical scanning apparatus according to claim 9, wherein the synchronization detect device is arranged at a side of a scanning starting position, and wherein the synchronization signal is obtained based upon an optical beam of the plurality of optical beams, that is incident onto the synchronization detect device last among the plurality of optical beams.

11. The multi-beam optical scanning apparatus according to claim 8, further comprising:

a synchronization detect device arranged at a position equivalent to the scanning surface and configured to obtain a synchronization signal for each of the plurality of optical beams, wherein when a distance between adjacent optical beams on the scanning surface is Δ; and an angle relative to the main scanning direction of the adjacent optical beams on the scanning surface is θ, a following conditional expression is satisfied:

$$\Delta\times\cos\theta>3\times\omega_m.$$

12. The multi-beam optical scanning apparatus according to claim 8, wherein β satisfies a following conditional expressions:

$$0.5<\beta<1.5.$$

13. The multi-beam optical scanning apparatus according to claim 8, wherein $P_{LD}$ is equal to or smaller than 100 μm.

14. The multi-beam optical scanning apparatus according to claim 8, wherein the opening of the aperture is formed in an ellipse.

15. A multi-beam optical scanning apparatus comprising:

a semiconductor laser array slanted relative to a sub-scanning direction and emitting a plurality of optical beams;

a coupling lens converting a shape of each optical beam emitted from the semiconductor laser array; and an aperture with an opening having a size of $A_m \times A_s$, arranged after the coupling lens in a direction in which the optical beam processes wherein $A_m$ is a dimension of the opening in a main scanning direction and $A_s$ is a dimension of the opening in the sub-scanning direction, wherein when a length in the main scanning direction of a contour line defined by $1/e^2$ strength of a maximum strengh of an optical beam at a position of the aperture is $L_m$; and a length in the sub-scanning direction of the contour line defined by $1/e^2$ strength of the maximum strength of the optical beam at the position of the aperture is $L_s$, following conditional expressions are satisfied:

$A_m < L_m$, and $$L_s/L_m \times 0.3 < A_s/A_m < L_s/L_m \times 1.7;$$

wherein when an image forming lateral magnification of an entire system of the optical scanning apparatus in the sub-scanning direction is $\alpha$, an interval of light emitting points of the semiconductor laser array is $P_{LD}$; a rotation angle of the semiconductor laser array in the sub-scanning direction is $\gamma$; a number of the light emitting points of the semiconductor laser array is n, a following conditional expression is satisfied;

$$P_{LD} \times (n-1) \times \alpha \times (\cos(\gamma-1) - \cos\gamma) \times dpi/25.4 < 0.5.$$

16. A multi-beam optical scanning apparatus comprising:

a semiconductor laser array slanted relative to a sub-scanning direction and emitting a plurality of optical beams;

a coupling lens converting a shape of each optical beam emitted from the semiconductor laser array;

an optical deflector deflecting the optical beam in a main scanning direction; and an image forming optical system arranged after the optical deflector in a direction in which the optical beam progresses and condensing the optical beam to obtain an optical spot having a size of $\omega_m \times \omega_s$ on a scanning surface, wherein $\omega_m$ is a dimension of the optical spot in the main scanning direction and $\omega_s$ is a dimension of the optical spot in the sub-scanning direction, wherein when an image forming lateral magnification of the image forming optical system in the sub-scanning direction is $\beta$; an interval of light emitting points of the semiconductor laser array is $P_{LD}$; a rotation angle of the semiconductor laser array in the sub-scanning direction is $\gamma$, a number of the light emitting points of the semiconductor laser array is n; a distance from the coupling lens to the optical deflector is d; and a focal length of the coupling lens is $f_{COL}$, a following conditional expression is satisfied:

$$0 < \{\beta \times P_{LD} \times \sin\gamma \times (n-1) \times (d - f_{COL})/f_{COL}\}/\omega_s < 100;$$

wherein when an image forming lateral magnification of an entire system of the optical scanning apparatus in the sub-scanning direction is $\alpha$, a following conditional expression is satisfied;

$$P_{LD} \times (n-1) \times \alpha \times (\cos(\gamma-1) - \cos\gamma) \times dpi/25.4 < 0.5.$$

17. An image forming apparatus comprising:

a photoconductive image bearing member;

an optical scanning device configured to scan a scanning surface of the photoconductive image bearing member with a plurality of optical beams to form an electrostatic latent image on the scanning surface of the photoconductive image bearing member; and a development device configured develop the electrostatic latent image to be visualized, wherein the optical scanning device includes:

a semiconductor laser array slanted relative to a sub-scanning direction and emitting the plurality of optical beams;

a coupling lens converting a shape of each optical beam emitted from the semiconductor laser array; and an aperture with an opening having a size of $A_m \times A_s$, arranged after the coupling lens in a direction in which the optical beam progresses, wherein $A_m$ is a dimension of the opening in a main scanning direction and $A_s$ is a dimension of the opening in the sub-scanning direction, wherein in the optical scanning device, when a length in the main scanning direction of a contour line defined by $1/e^2$ strength of a maximum strength of an optical beam at a position of the aperture is $L_m$; and a lenght in the sub-scannin direction of the contour line defined by $1/e^2$ strength of the maximum strength of the optical beam at the position of the aperture is $L_s$, following conditional expressions are satisfied:

$A_m < L_m$;

$$L_s/L_m \times 0.3 < A_s/A_m < L_s/L_m \times 1.7;$$

wherein the optical scanning device further includes:

an optical deflector deflecting the optical beam in the main scanning direction, and an image forming optical system arranged after the optical deflector in a direction in which the optical beam progresses and condensing the optical beam to obtain an optical spot having a size of $\omega_m \times \omega_s$ on the scanning surface, wherein $\omega_m$ is a dimension of the optical spot in the main scanning direction and $\omega_s$ is a dimension of the optical spot in the sub-scanning direction, and wherein in the optical scanning device, when a size of an effective area of a surface of the optical deflector is $D_m \times D_s$, $D_m$ being a dimension of the effective area in the main scanning direction and $D_s$ being a dimension of the effective area in the sub-scanning direction; a distance in the main scanning direction between optical beams of the plurality of optical beams reaching the optical deflector, that are separated at most in the main scanning direction, is $\delta$; and an effective writing width on the scanning surface is W, a following conditional expression is satisfied:

$$(D_m \times \omega_m)/(\delta \times W) > 5 \times 10^{-4}.$$

18. The image forming apparatus according to claim 17, wherein the optical scanning device further includes:

a synchronization detect device arranged at a position equivalent to a scanning surface and configured to obtain a synchronization signal based upon one of the plurality of optical beams, wherein in the optical scanning device, when a distance between adjacent optical beams on the scanning surface is $\Delta$; and an angle relative to the main scanning direction of the adjacent optical beams on the scanning surface is θ, a following conditional expression is satisfied:

$$\Delta\times(\cos(\theta-1)-\cos\theta)\times dpi/25.4<1/8.$$

19. The image forming apparatus to claim 18, wherein in the optical scanning device, the synchronization detect device is arranged at a side of a scanning starting position, and the synchronization signal is obtained based upon an optical beam of the plurality of optical beams, that is incident onto the synchronization detect device last among the plurality of optical beams.

20. The image forming apparatus according to claim 17, wherein the optical scanning device further includes:

a synchronization detect device arranged at a position equivalent to the scanning surface and configured to obtain a synchronization signal for each of the plurality of optical beams, wherein in the optical scanning device, when a distance between adjacent optical beams on the scanning surface is Δ; and an angle relative to the main scanning direction of the adjacent optical beams on the scanning surface is θ, a following conditional expression is satisfied:

$$\Delta\times\cos\theta>3\times\omega_m.$$

21. The image forming apparatus according to claim 17, wherein in the optical scanning device, when an image forming lateral magnification of the image fonning optical system in the sub-scanning direction is β, β satisfies a following conditional expression:

$$0.5<\beta<1.5.$$

22. The image forming apparatus according to claim 17, wherein in the optical scanning device, when an interval of light emitting points of the semiconductor laser array is $P_{LD}$, $P_{LD}$ is equal to or smaller than 100 μm.

23. The image forming apparatus according to claim 17, wherein in the optical scanning device, the opening of the aperture is formed in an ellipse.

24. An image forming apparatus comprising:

a photoconductive image bearing member;

an optical scanning device configured to scan a scanning surface of the photoconductive image bearing member with a plurality of optical beams to form an electrostatic latent image on the scanning surface of the photoconductive image bearing member; and a development device configured develop the electrostatic latent image to be visualized, wherein the optical scanning device includes:

a semiconductor laser array slanted relative to a sub-scanning direction and emitting the plurality of optical beams, a coupling lens converting a shape of each optical beam emitted from the semiconductor laser array, an optical deflector deflecting the optical beam in a main scanning direction, and an image forming optical system arranged after the optical deflector in a direction in which the optical beam progresses and condensing the optical beam to obtain an optical spot having a size of $\omega_m\times\omega_s$ on the scanning surface wherein, $\omega_s$ is a dimension of the optical spot in the main scanning direction and $\omega_s$ is a dimension of the optical spot in the sub-scanning direction, wherein in the optical scanning device, when an image forming lateral magnification of the image forming optical system in the sub-scanning direction is β; an interval of light emitting points of the semiconductor laser array is $P_{LD}$; a rotation angle of the semiconductor laser array in the sub-scanning direction is γ, a number of the light emitting points of the semiconductor laser array is n; a distance from the coupling lens to the optical deflector is d; and a focal length of the coupling lens is $f_{COL}$, a following conditional expression is satisfied:

$$0<\{\beta\times P_{LD}\times\sin\gamma\times(n-1)\times(d-f_{COL})/f_{COL}\}/\omega_s<100;$$

wherein in the optical scanning device, when a size of an effective area of a surface of the optical deflector is $D_m\times D_s$, $D_m$ being a dimension of the effective area in the main scanning direction and $D_s$ being a dimension of the effective area in the sub-scanning direction; a distance in the main scanning direction between optical beams of the plurality of optical beams reaching the optical deflector, that are separated at most in the main scanning direction, is δ; and an effective writing width on the scanning surface is W, a following conditional expression is satisfied:

$$(D_m\times\omega_m)/(\delta\times W)>5\times10^{-4}.$$

25. The image forming apparatus according to claim 24, wherein the optical scanning device further includes:

a synchronization detect device arranged at a position equivalent to the scanning surface and configured to obtain a synchronization signal based upon one of the plurality of optical beams, wherein in the optical scanning device, when a distance between adjacent optical beams on the scanning surface is Δ; and an angle relative to the main scanning direction of the adjacent optical beams on the scanning surface is θ, a following conditional expression is satisfied:

$$\Delta\times(\cos(\theta-1)-\cos\theta)\times dpi/25.4<1/8.$$

26. The image forming apparatus according to claim 25, wherein in the optical scanning device, the synchronization detect device is arranged at a side of a scanning starting position, and the synchronization signal is obtained based upon an optical beam of the plurality of optical beams, that is incident onto the synchronization detect device last among the plurality of optical beams.

27. The image forming apparatus according to claim 24, wherein the optical scanning device further includes:

a synchronization detect device arranged at a position equivalent to the scanning surface and configured to obtain a synchronization signal for each of the plurality of optical beams, wherein in the optical scanning device, when a distance between adjacent optical beams on the scanning surface is Δ; and an angle relative to the main scanning direction of the adjacent optical beams on the scanning surface is θ, a following conditional expression is satisfied:

$$\Delta\times\cos\theta>3\times\omega_m.$$

28. The image forming apparatus according to claim 24, wherein in the optical scanning device, β satisfies a following conditional expressions:

$$0.5<\beta<1.5.$$

29. The image forming apparatus according to claim 24, wherein in the optical scanning device, $P_{LD}$ is equal to or smaller than 100 μm.

30. The image forming apparatus according to claim 24, wherein in the optical scanning device, the opening of the aperture is formed in an ellipse.

31. An image forming apparatus comprising:

a photoconductive image bearing member;

an optical scanning device configured to scan a scanning surface of the photoconductive image bearing member with a plurality of optical beams to form an electrostatic latent image on the scanning surface of the photoconductive image bearing member; and a development device configured develop the electrostatic latent image to be visualized, wherein the optical scanning device includes:

a semiconductor laser array slanted relative to a sub-scanning direction and emitting the plurality of optical beams;

a coupling lens converting a shape of each optical beam emitted from the semiconductor laser array; and an aperture with an opening having a size of $A_m \times A_s$ arranged after the coupling lens in a direction in which the optical beam progesses, wherein $A_m$ is a dimension of the opening in a main scanning direction and $A_s$ is a dimension of the opening in the sub-scanning direction, wherein in the optical scanning device, when a length in the main scanning direction of a contour line defined by $1/e^2$ strength of a maximum strength of an optical beam at a position of the aperture is $L_m$; and a lenght in the sub-scanning direction of the contour line defined by $1/e^2$ strength of the maximum strength of the optical beam at the position of the aperture is $L_s$, following conditional expressions are satisfied:

$$A_m > L_m; \text{ and}$$

$$L_s/L_m \times 0.3 < A_s/A_m < L_m \times 1.7;$$

wherein in the optical scanning device, when an image forming lateral magnification of an entire system of the optical scanning device in the sub-scanning direction is $\alpha$, an interval of light emitting points of the semiconductor laser array is $P_{LD}$; a rotation angle of the semiconductor laser array in the sub-scanning direction is $\gamma$, a number of the light emitting points of the semiconductor laser array is n, a following conditional expression is satisfied:

$$P_{LD} \times (n-1) \times \alpha \times (\cos(\gamma-1) - \cos\gamma) \times dpi/25.4 < 0.5.$$

32. An image forming apparatus comprising:

a photoconductive image bearing member;

an optical scanning device configured to scan a scanning surface of the photoconductive image bearing member with a plurality of optical beams to form an electrostatic latent image on the scanning surface of the photoconductive image bearing member; and a development device configured develop the electrostatic latent image to be visualized, wherein the optical scanning device includes:

a semiconductor laser array slanted relative to a sub-scanning direction and emitting the plurality of optical beams, a coupling lens converting a shape of each optical beam emitted from the semiconductor laser array, an optical deflector deflecting the optical beam in a main scanning direction, and an image forming optical system arranged after the optical deflector in a direction in which the optical beam progresses and condensing the optical beam to obtain an optical spot having a size of $\omega_m \times \omega_s$ on the scanning surface, wherein $\omega_m$ is a dimension of the optical spot in the main scanning direction and $\omega_s$ is a dimension of the optical spot in the sub-scanning direction, wherein in the optical scanning device, when an image forming lateral magnification of the image forming optical system in the sub-scanning direction is $\beta$; an interval of light emitting points of the semiconductor laser array is $P_{LD}$; a rotation angle of the semiconductor laser array in the sub-scanning direction is $\gamma$, a number of the light emitting points of the semiconductor laser array is n; a distance from the coupling lens to the optical deflector is d; and a focal length of the coupling lens is $f_{COL}$, a following conditional expression is satisfied:

$$0 < \{\beta \times P_{LD} \times \sin\gamma \times (n-1) \times (d - f_{COL})/f_{COL}\}/\omega_s < 100;$$

wherein in the optical scanning device, when an image forming lateral magnification of an entire system of the optical scanning device in the sub-scanning direction is $\alpha$, a following conditional expression is satisfied:

$$P_{LD} \times (n-1) \times \alpha \times (\cos(\gamma-1) - \cos\gamma) \times dpi/25.4 < 0.5.$$

33. A multi-beam optical scanning means, comprising:

emitting means slanted relative to a sub-scanning direction, for emitting a plurality of optical beams;

converting means for converting a shape of each optical beam emitted from the emitting means; and aperture means with an opening having a size of $A_m \times A_s$, arranged after the converting means in a direction in which the optical beam progresses, wherein $A_m$ is a dimension of the opening in a main scanning direction and $A_s$ is a dimension of the opening in the sub-scanning direction, wherein when a length in the main scanning direction of a contour line defined by $1/e^2$ strength of a maximum strength of an optical beam at a position of the aperture means is $L_m$; and a length in the sub-scanning direction of the contour line defined by $1/e^2$ strength of the maximum strength of the optical beam at the position of the aperture means is $L_s$, following conditional expressions are satisfied:

$$A_m > L_m; \text{ and}$$

$$L_s/L_m \times 0.3 < A_s/A_m < L_m \times 1.7;$$

wherein the multi-beam optical scanning means further comprises:

deflecting means for deflecting the optical beam in the main scanning direction; and image forming means arranged after the deflecting means in a direction in which the optical beam progresses and condensing the optical beam to obtain an optical spot having a size of $\omega_m \times \omega_s$ on a scanning surface, wherein $\omega_m$ is a dimension of the optical spot in the main scanning direction and $\omega_s$ is a dimension of the optical spot in the sub-scanning direction, wherein when a size of an effective area of a surface of the deflecting means is $D_m \times D_s$, $D_m$ being a dimension of the effective area in the main scanning direction and $D_s$ being a dimension of the effective area in the sub-scanning direction; a distance in the main scanning direction between optical beams of the plurality of optical beams reaching the deflecting means, that are separated at most in the main scanning direction, is $\delta$; and an effective writing width on the scanning surface is W, a following conditional expression is satisfied:

$$(D_m \times \omega_m)/(\delta \times W) > 5 \times 10^{-4}.$$

* * * * *